US012259213B2

(12) United States Patent
Roberts et al.

(10) Patent No.: US 12,259,213 B2
(45) Date of Patent: Mar. 25, 2025

(54) FIREARM CASE WITH LOCKING LATCHES

(71) Applicant: Magpul Industries Corp., Austin, TX (US)

(72) Inventors: Timothy Eric Roberts, Broomfield, CO (US); Michael Werner, Arvada, CO (US); William Furman O'Dell, Evergreen, CO (US); Clinton Wade Lynch, Erie, CO (US); Michael T. Mayberry, Denver, CO (US)

(73) Assignee: Magpul Industries, Corp., Austin, TX (US)

( * ) Notice: Subject to any disclaimer, the term of this patent is extended or adjusted under 35 U.S.C. 154(b) by 0 days.

(21) Appl. No.: 18/029,267

(22) PCT Filed: Jan. 8, 2023

(86) PCT No.: PCT/US2023/010367

§ 371 (c)(1),
(2) Date: Mar. 29, 2023

(87) PCT Pub. No.: WO2023/172351

PCT Pub. Date: Sep. 14, 2023

(65) Prior Publication Data

US 2024/0280346 A1 Aug. 22, 2024

Related U.S. Application Data

(60) Provisional application No. 63/319,194, filed on Mar. 11, 2022, provisional application No. 63/319,221, filed on Mar. 11, 2022.

(51) Int. Cl.

| | |
|---|---|
| ***F41C 33/06*** | (2006.01) |
| ***A45C 13/02*** | (2006.01) |
| ***A45C 13/10*** | (2006.01) |

(52) U.S. Cl.
CPC ..... *F41C 33/06* (2013.01); *A45C 13/02* (2013.01); *A45C 13/1084* (2013.01); *A45C 2013/026* (2013.01)

(58) Field of Classification Search
CPC ..... A45C 13/02; A45C 13/1084; A45C 2013/026; F41C 33/06
(Continued)

(56) References Cited

U.S. PATENT DOCUMENTS

| | | | |
|---|---|---|---|
| 144,431 | A | 11/1873 | Beck |
| 985,385 | A | 2/1911 | Bayles |

(Continued)

FOREIGN PATENT DOCUMENTS

| | | | |
|---|---|---|---|
| CN | 1648390 | B | 1/2011 |
| CN | 212165168 | U | 12/2020 |

(Continued)

OTHER PUBLICATIONS

Guidry, Abigial E., Office Action re U.S. Appl. No. 18/029,304, filed Dec. 18, 2023, 65 Pages, United States Patent and Trademark Office, US.

(Continued)

*Primary Examiner* — Ernesto A Grano
(74) *Attorney, Agent, or Firm* — Neugeboren O'Dowd, P.C.

(57) ABSTRACT

A locking case including a base and a lid includes a latch recess integrated into an outer profile of the case, and a latch installed within the latch recess. The latch includes a latch handle including a first end, rotatably coupled with the lid, and a second end including an end protrusion configured for removably engaging with a first portion of the base. The latch also includes a passthrough feature for accommodating a lock mechanism therethrough. The latch handle is larger than the locking mechanism. The latch recess fully accom- (Continued)

modates the latch and most or all of the lock mechanism therein when the second end of the latch handle is engaged with the first portion of the base and the lock mechanism is installed through the passthrough feature such that the latch and the lock mechanism do not substantially protrude from the outer profile of the case.

18 Claims, 27 Drawing Sheets

(58) Field of Classification Search
USPC ..... 206/317
See application file for complete search history.

(56) References Cited

U.S. PATENT DOCUMENTS 2,621,807 A 12/1952 Rendich
4,239,230 A 12/1980 Shoptaugh
4,446,900 A 5/1984 Markovich
4,714,158 A 12/1987 Oltman et al.
4,733,806 A 3/1988 Sloop
5,055,081 A 10/1991 Nayak
5,106,132 A 4/1992 Bako et al.
5,350,150 A * 9/1994 Fiore ..... A45C 13/18 248/552
5,375,440 A * 12/1994 Patterson ..... F41C 33/06 70/164
5,472,110 A * 12/1995 Boyd ..... B25H 3/02 220/326
5,605,167 A 2/1997 Montoli
6,390,294 B1 * 5/2002 Fiore, Jr. ..... F41B 5/1457 206/315.11
6,527,309 B1 3/2003 Gaydos et al.
6,575,313 B1 6/2003 Chen
6,769,538 B2 8/2004 Oswald
6,880,698 B2 * 4/2005 Fiore, Jr. ..... F41B 5/1457 292/249
6,955,381 B2 10/2005 Parker et al.
D520,734 S 5/2006 Henning et al.
D527,181 S 8/2006 Henning et al.
7,121,407 B2 10/2006 Hurt et al.
7,246,704 B2 7/2007 Brunson et al.
7,370,891 B1 5/2008 Schmitt et al.
7,401,698 B2 6/2008 Dost et al.
7,424,958 B1 9/2008 Eley
7,451,872 B1 11/2008 Allen
7,513,364 B2 4/2009 Tsai
7,540,364 B2 6/2009 Sanderson
7,546,920 B1 6/2009 Horn et al.
7,573,385 B2 8/2009 Tonelli
D633,298 S 3/2011 Tonelli
8,141,723 B2 3/2012 Whalen et al.
8,297,464 B2 10/2012 Grenier et al.
8,328,247 B2 12/2012 Tonelli
8,371,444 B1 2/2013 Huang
8,381,912 B2 2/2013 Dalhamer
8,944,476 B1 * 2/2015 Henderson ..... E05B 15/02 292/285
8,960,430 B2 2/2015 Roach et al.
8,985,385 B2 3/2015 Parker et al.
RE45,787 E 11/2015 Hurt et al.
9,187,933 B2 11/2015 Lucas
9,199,370 B2 * 12/2015 Crull ..... B65D 25/28
D749,845 S 2/2016 Tonelli
D778,707 S 2/2017 Tonelli
D779,822 S 2/2017 Grenier et al.
9,656,384 B1 5/2017 Tsai
D810,432 S 2/2018 Ballou et al.
D810,433 S 2/2018 Ballou et al.
D811,084 S 2/2018 Ballou et al.
D811,742 S 3/2018 Ballou et al.
D811,744 S 3/2018 Ballou et al.
9,975,672 B2 5/2018 Crull
D819,331 S 6/2018 Ballou et al.
10,012,632 B2 7/2018 Tomellini et al.
10,182,628 B2 1/2019 Tonelli et al.
10,231,524 B2 3/2019 Tonelli et al.
D854,826 S 7/2019 Tonelli
D873,007 S 1/2020 Tonelli
10,618,159 B2 4/2020 Maruzzo et al.
10,716,399 B2 7/2020 Brown et al.
D898,357 S 10/2020 Chagnon et al.
D898,358 S 10/2020 Chagnon et al.
D898,546 S 10/2020 Tonelli
10,858,160 B2 * 12/2020 Yang ..... B65D 43/0202
D915,069 S 4/2021 Tonelli
11,064,778 B2 7/2021 Tonelli
11,203,465 B2 * 12/2021 Seiders ..... B65D 43/22
11,358,272 B2 6/2022 Bühl et al.
11,419,364 B2 8/2022 Slate et al.
11,976,498 B2 * 5/2024 Seiders ..... E05B 17/2057
2002/0023855 A1 2/2002 Cho
2002/0034321 A1 * 3/2002 Saito ..... G06V 40/12 382/124
2003/0121741 A1 * 7/2003 Japchen ..... E05B 65/52 70/49
2004/0144664 A1 * 7/2004 Hammill ..... F41C 33/06 206/315.11
2004/0154935 A1 * 8/2004 Kaminski ..... A45C 13/02 206/6.1
2004/0178202 A1 9/2004 Serio, Jr.
2005/0269340 A1 12/2005 Chuan
2005/0279123 A1 12/2005 Maldonado et al.
2006/0070900 A1 4/2006 Brunson et al.
2006/0266666 A1 11/2006 Bettenhausen et al.
2007/0007291 A1 1/2007 Gunn
2007/0012694 A1 1/2007 Duvigneau
2007/0051722 A1 3/2007 Van Zee
2007/0262038 A1 11/2007 Harbison et al.
2007/0272572 A1 11/2007 Chen
2008/0136301 A1 6/2008 Harbison et al.
2009/0107875 A1 4/2009 Carroll et al.
2009/0114646 A1 5/2009 Whalen
2009/0145913 A1 * 6/2009 Panosian ..... B62B 1/12 220/666
2009/0146032 A1 6/2009 Bettenhausen et al.
2011/0147386 A1 6/2011 Whalen
2012/0199513 A1 * 8/2012 Wagner ..... B65D 21/0233 206/505
2014/0265197 A1 9/2014 Russell et al.
2014/0346068 A1 11/2014 Omura et al.
2015/0251311 A1 9/2015 Huang
2016/0073751 A1 3/2016 Charlebois et al.
2016/0280421 A1 9/2016 Lee et al.
2017/0008688 A1 1/2017 Barattin et al.
2017/0361987 A1 12/2017 Lee et al.
2018/0265249 A1 9/2018 Grutt
2019/0271433 A1 9/2019 Tonelli
2020/0039056 A1 2/2020 Damberg
2020/0229568 A1 7/2020 Nichols et al.
2020/0275750 A1 9/2020 Dawe
2020/0324943 A1 * 10/2020 Mattila ..... E05B 17/0025
2020/0353612 A1 11/2020 McCune et al.
2020/0354117 A1 11/2020 Whalen et al.
2021/0080224 A1 * 3/2021 Searle ..... B65D 81/052
2021/0137294 A1 5/2021 Beyer et al.
2021/0204663 A1 * 7/2021 Nichols ..... A45C 5/141
2021/0365917 A1 11/2021 Tusia Cohen
2022/0316840 A1 10/2022 Ryder et al.
2023/0011990 A1 1/2023 Makos
2023/0120366 A1 4/2023 Stevens
2023/0243619 A1 * 8/2023 Searle ..... F41C 33/06 206/522
2024/0053121 A1 * 2/2024 Searle ..... F41C 33/06
2024/0209675 A1 * 6/2024 Curtis ..... E05G 1/024

FOREIGN PATENT DOCUMENTS

DE 10-2010-037350 A1 4/2011
DE 20-2012-103961 U1 1/2014
DE 20-2017-105501 U1 9/2017

(56) References Cited

FOREIGN PATENT DOCUMENTS

| | | | |
|---|---|---|---|
| DE | 20-2018-105387 | U1 | 1/2019 |
| EP | 2 130 451 | B1 | 8/2014 |
| EP | 2 315 895 | B1 | 1/2015 |
| EP | 3 438 385 | B1 | 6/2020 |
| EP | 3 598 917 | B1 | 9/2021 |
| EP | 3911199 | A1 | 11/2021 |
| JP | 6964508 | B2 | 11/2021 |
| WO | 2011/06621 | A1 | 1/2011 |
| WO | 2011/066217 | A3 | 9/2011 |
| WO | 2018/131054 | A1 | 7/2018 |
| WO | 2020/148495 | A1 | 7/2020 |
| WO | 2020/227523 | A1 | 11/2020 |
| WO | 2021/213718 | A1 | 10/2021 |

OTHER PUBLICATIONS

School Supply, Discount. "Excellerations earlySTEMTM Translucent Stacking Pegs." Discount School Supply, Discount School Supply, Nov. 13, 2020, www.discountschoolsupply.com/stem-curriculum/stem/earlystem-/excellerations-earlystem--translucent-stacking-pegs/p/s650981. Year: 2020.

"1720 Protector Long Case", Pelican, 3 pages, online available at <https://www.pelican.com/US/en/product/cases/long-case/protector/1720>, retrieved on: Jul. 7, 2022.

"1750 Protector Long Case", Pelican, 3 pages, online available at <https://www.pelican.com/us/en/product/cases/long-case/protector/1750>, retrieved on: Jul. 7, 2022.

"Draw Latches", McMaster-Carr, 2 pages, online available at <https://www.mcmaster.com/draw-latches/>, retrieved on: Jul. 7, 2022.

"Pistol Cases", Pelican, 2 pages, online available at <https://www.pelican.com/us/en/products/cases/pistol-cases>, retrieved on: Jul. 7, 2022.

"R40 Personal Utility Ruck Case", Pelican, 4 pages, online available at <https://www.pelican.com/us/en/product/cases/ruck-case/personal-utility/r40?sku=RKR400-0000-TAN>, retrieved on: Jan. 7, 2023.

"RC42T—Tactical Rifle Case 42", MTM Case-Gard, 2 pages, online available at <https://mtmcase-gard.com/products/tactical-rifle-case 42>, retrieved on: Jan. 7, 2023.

"Rustrictor™ AW2 42" Rifle Case, Plano, 2 pages, online available at <https://planomolding.com/products/rustrictor-aw2-42in-rifle-case-pla11842r?variant=40468122796192>, retrieved on: Jul. 7, 2022.

International Search Report and Written Opinion received for International PCT Application Serial No. PCT/US23/10367 dated May 8, 2023, 8 pages.

Taiwanese Patent Application No. 112100930, Search Report dated Dec. 16, 2024. 1 page.

* cited by examiner

FIREARM CASE WITH LOCKING LATCHES

CROSS-REFERENCE TO RELATED APPLICATIONS

The present application claims priority to US Provisional Patent Application Ser. No. 63/319,194 filed Mar. 11, 2022, and titled "Firearm Case with Locking Latches." The present application is also related to US Provisional Patent Application Ser. No. 63/319,221 filed Mar. 11, 2022, and titled "Storage Case Organizational System." Both of the above referenced applications are incorporated herein by reference in their entirety.

FIELD OF THE INVENTION

The present invention relates to cases. In particular, but not by way of limitation, the present invention relates to firearm cases with locking latches.

DESCRIPTION OF RELATED ART

Transport and storage cases are used across a variety of industries, such as for scientific equipment, sporting goods, photography equipment, mechanical tools, electronics devices, military gear, and other valuables that are susceptible to damage during transport or storage. Such cases often suffer from a drawbacks, such as fragility of the cases themselves and difficulties in preventing unwanted access to the contents. In particular, cases used to store and/or transport firearms are typically made of plastic and feature small latches, rudimentary provisions for padlocks, relatively smooth exteriors, molded-in or folding handles, and/or basic foam interiors. While some aspects of cases have improved over time, there remain unmet needs within the realm of cases.

For example, while many latch designs exist today, they are often inadequate and/or cumbersome. In some cases, latch designs include a single-pivot system, which require the latch itself to have enough flexibility to snap over a mating retention feature and lock in place. More recently, locking latches featuring a secondary button have been employed. While the secondary button feature improves latch retention and/or ease of closing, these latches are often small (e.g., two inches in width or smaller). In some circumstances, rifle case(s) include four or more latches around the periphery of the case, which increases the time and complexity of opening/closing the case. Additionally, or alternatively, smaller latches are often uncomfortable for the use. For instance, smaller latches may require a user to apply a significant amount of force to open or close, e.g., by pounding their fist on the latch, using a tool, etc. In other cases, smaller latches are difficult to interact with, for instance, when the user is wearing gloves.

Additionally, existing latches are difficult to secure against intrusion, as currently available locking mechanisms are often exposed (i.e., protrudes from the external profile of the case). Exposed locking mechanisms are susceptible to unintentional or intentional damage, thus are relatively easy to defeat by application of force using tools such as hammers and cutters. Further, exposed locking mechanisms can damage or injury to other objects that come into contact with the case, especially when the loaded case is heavy.

Thus, there is a need for an improved firearm case and latch design that enhances user experience.

SUMMARY OF THE INVENTION

The following presents a simplified summary relating to one or more aspects and/or embodiments disclosed herein.

As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

As noted above, current designs for firearm cases suffer some deficiencies, especially with regards to ease of use, ergonomics, locking and/or latching mechanisms, to name a few. Aspects of the present disclosure are generally directed to a firearm case (e.g., rifle/shotgun/pistol case) with locking latches that alleviate some of the issues in the prior art cases. In some embodiments, the firearm case (simply referred to as, case) comprises one or more latches on the periphery of the case. In some cases, the latches are at least 6 inches in width, 8 inches in width, or 9 inches in width, to name a few non-limiting examples. It should be noted that, the latch dimensions listed herein are not intended to be limiting, and latches with different dimensions are contemplated in different embodiments. In some cases, the latches may be of a sufficient width to allow a user/operator to interact with the latch for opening/closing the case using a single hand. In some cases, the latches may include an integrated spring-loaded hook feature, where the hook rotates out of the way when closing the case. Additionally, or alternatively, each of the latches may include buttons for rotating the hooks, enabling the user to open the latch with one hand. In some cases, a case may comprise at least two latches. In some aspects, the larger size of the latches (i.e., as compared to the prior art) may allow the user to apply enough force to close and seal the case, as well as spread out any compressive forces to ensure water/weather resistances, with fewer latches than in the prior art.

In an embodiment, a locking case including a base and a lid includes a latch recess integrated into an outer profile of the case, and a latch installed within the latch recess. The latch includes a latch handle including a first end, rotatably coupled with the lid, and a second end including an end protrusion configured for removably engaging with a first portion of the base. The latch also includes a passthrough feature for accommodating a lock mechanism therethrough. The latch handle is larger than the locking mechanism. The latch recess accommodates the latch and the lock mechanism (or substantially all of the lock mechanism) therein when the second end of the latch handle is engaged with the first portion of the base and the lock mechanism is installed through the passthrough feature such that the latch and the lock mechanism do not substantially protrude from the outer profile of the case. In a further embodiment, the lock mechanism is a padlock.

In a still further embodiment, the latch further includes a button, which includes at least one hook mechanism for engaging with a second portion of the base. The button may be rotatably coupled with the latch handle such that the at least one hook mechanism remains engaged with the second portion of the base, independently from the second end of the latch handle, unless the button is depressed to disengage the at least one hook mechanism from the second portion of the base.

In another embodiment, the lid of the case includes a recess for capturing a tip of the first end of the latch handle when the second end of the latch handle is disengaged from the portion of the base of the case and rotated to an open position such that the latch handle is retained in the open position by the recess.

In certain embodiments, the latch handle includes a latch width greater than two inches. In certain embodiments, the latch width may be greater than three inches.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of 'a', 'an', and 'the' include plural referents unless the context clearly dictates otherwise

DETAILED DESCRIPTION

The word "exemplary" is used herein to mean "serving as an example, instance, or illustration." Any embodiment described herein as "exemplary" is not necessarily to be construed as preferred or advantageous over other embodiments. In the following detailed description, references are made to the accompanying drawings that form a part hereof, and in which are shown by way of illustrations or specific examples. These aspects may be combined, other aspects may be utilized, and structural changes may be made without departing from the present disclosure. Example aspects may be practiced as methods, systems, or apparatuses. The following detailed description is therefore not to be taken in a limiting sense, and the scope of the present disclosure is defined by the appended claims and their equivalents.

Figure 1:
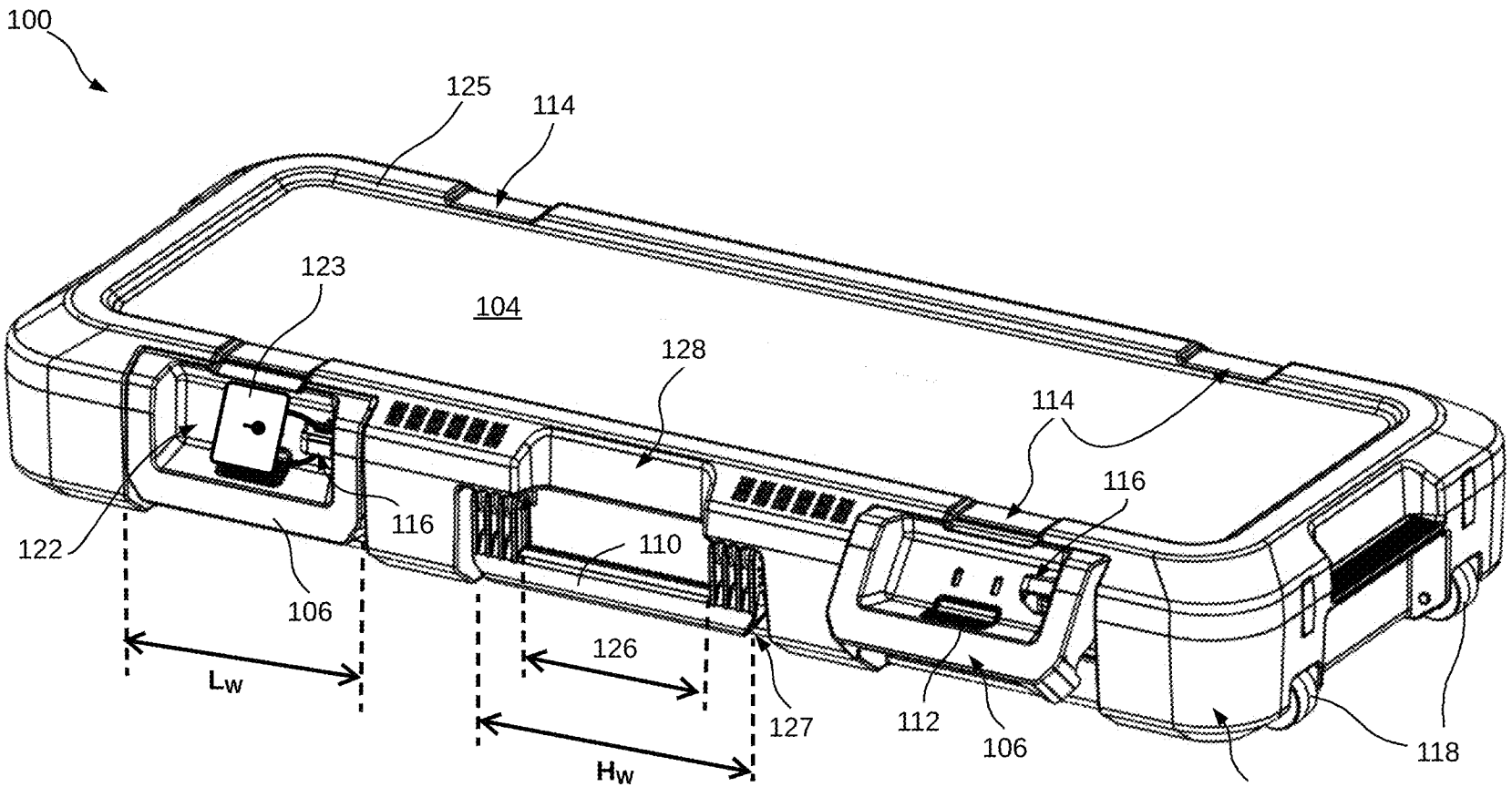
FIG. 1 illustrates a perspective view of a case 100, according to various aspects of the present disclosure.

FIG. 1 illustrates a top perspective view of a case 100, according to various aspects of the present disclosure. Case 100 may be implemented, for example, as a firearm case. As seen, case 100 includes a base 102, a lid 104, a plurality of latches 106, at least one handle 110, one or more wheels 118, and a plurality of lid channels 114. Base 102 and lid 104 may be coupled on one side (or along one edge, such as one of the longer edges) using one or more hinges or pivots, shown as hinges/pivots 120 in FIG. 2, while latches 106 may be positioned on the opposing edge (e.g., the other of the two longer edges) of case 100. Optionally, lid 104 may include a ridge feature 125 for cooperating with one or more boss features on the base of a second case (not shown) to securely stack multiple cases atop each other. In some cases, latches 106 may be pivotally coupled to lid 104. For instance, latches 106 may be coupled to lid 104 when case 100 is open and may help secure the lid to the base when the case is closed. This securement may be achieved by snapping one or more inward facing protrusions of the latch on corresponding mating retention features (e.g., one or more outward facing protrusions/lips) of the base and/or lid. In some other cases, latches 106 may be pivotally coupled to base 102.

Each one of the plurality of latches 106 may have a latch width $L_w$ of several inches, such as 2 inches or longer. For example, each latch 106 may have a latch width $L_w$ of six inches to be readily grasped by an adult hand. Alternatively, the size of the latch may be designed such that a commonly used locking mechanism, such as a padlock, may be secured within a latch recess 122 (indicated by an arrow) without protruding from the external profile of case 100. That is, latch width $L_w$ as well as the dimensions of latch recess 122 may be configured to fully accommodate a locking mechanism therein, without exposing the locking mechanism outside of the external profile of case 100. Alternatively, most of the locking mechanism can be accommodated, such that the locking mechanism does not substantially protrude from the external profile of the case 100. In other words, a few millimeters of the locking mechanism can protrude without causing a significant risk of snagging, though it is preferred that the locking mechanism being fully accommodated in the recess 122. Further, there may be different sizes of locking mechanisms such that some are fully accommodated while others have a slight protrusion beyond the external profile of the case 100. In some cases, the latches are at least 6 inches in width, 8 inches in width, or 9 inches in width, to name a few non-limiting examples. Further, as shown in FIG. 1, latch 106 may be arranged with a general U-shape with a cut-out to further facilitate grasping of latch 106 even while wearing gloves or other protective gear or in adverse environmental conditions, such as in rain or snow.

In some cases, case 100 further includes at least one pivotable handle 110 (e.g., a carrying handle), where handle 110 is pivotally coupled with one of base 102 and lid 104. In a manner similar to the sizing of latches 106, handle 110 may be formed with a handle width $H_w$ of sufficient width for comfortable gripping by an adult hand. For example, handle 110 may have a handle width Hw of eight inches, with an internal width 126 of six inches. In an embodiment, a handle recess 127 may be formed into the outer profile of case 100 such that handle 110 may be stored into handle recess 127 (i.e., within the external profile of case 100) when not in use. Additionally, case 100 may include a grip recess 128 to assist with grasping of the handle by a user. Further functional advantages provided by the latches, handle, and overall case design of the described embodiments will be discussed in more detail below. Case 100 may additionally include one or more wheels along one edge, for instance, along one of the shorter edges of base 102. In the illustrated example, a pair of wheels 118 are positioned within wheel recesses on one of the two short edges of base 102.

It is noted that, the number and dimensions of the latches used may be adjusted according to the dimensions of the case. For instance, while two latches are shown in FIG. 1, a fewer number of latches may be required for a smaller case, such as that used for the transport and storage of a pistol. Conversely, larger latches, or more than four latches or latches placed on more than one edge of the case, may be appropriate for securing a longer or larger case or a case intended for storing and transporting a very heavy object. In certain use scenarios, such as for cases intended for use in harsh environmental conditions (e.g., extremely cold or hot temperatures, very wet or dry conditions, or even for extra-terrestrial uses), the latches may be required to be larger and ruggedized to withstand such conditions. Various features of the case and latch embodiments described herein are still applicable for these various use cases, with modifications in dimensions, material composition, number, and location. Such modifications are considered a part of the present disclosure, and the examples described herein are not considered to be limiting.

Figure 2:
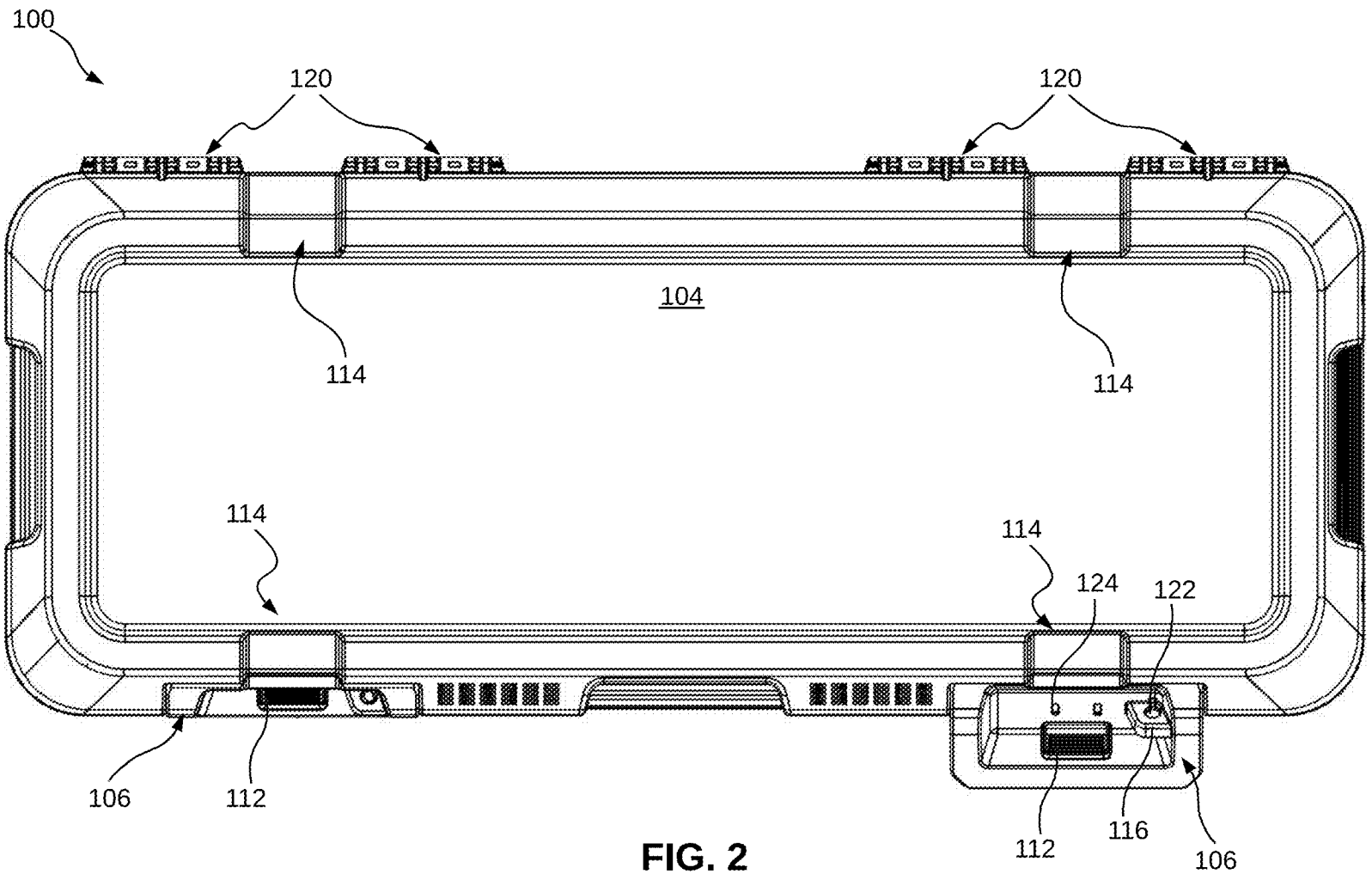
FIG. 2 illustrates a top view of case 100 in FIG. 1, according to various aspects of the disclosure.

FIG. 2 illustrates a top view of case 100 of FIG. 1, in accordance with an embodiment. As can be seen in FIG. 2, hinges/pivots 120 are positioned on one edge (e.g., one of the two long edges of case 100), while latches 106 are pivotally coupled with an opposing edge of case 100 (e.g., on a long edge of lid 104 opposite hinges/pivots 120). Further, each one of latches 106 may include a button 112 positioned within a recess in latch 106. In an embodiment, button 112 may be configured to cooperate with a respective latch 106 such that a user/operator may push button 112 to disengage latch 106 from base 102 to open lid 104 of case 100. Further details of the operation of latch 106 and button 112 will be described with respect to FIGS. 11-13 below. FIG. 2 depicts one of latches 106 (i.e., the latch on the left side of the page) in a closed/engaged position, and the other one of latches 106 (i.e., the latch on the right side of the page) in an open/disengaged position. In the engaged position, latch 106 engages/interfaces with both base 102 and lid 104. In the disengaged position, latch 106 is shown to be pivotally coupled with lid 104 and not engaged with base 102.

Currently used latches for cases, such as firearm cases, often include padlock passthroughs (i.e., holes for receiving a padlock therethrough) that are separate from the latches. In some cases, these padlock passthroughs are positioned such that a padlock may be passed through both a portion of the lid and the base of the case to prevent the case from being fully opened with the padlock in place. In some instances, however, the latches may be operated independently of the padlock such that the case may be at least partially opened even with a padlock in place. Such a partial opening may allow small parts stored in the firearm case to fall out of the case. In some cases, the partial opening may present a sufficiently large gap to allow a pry bar or another tool to be used to access the contents of the firearm case. Further, prior art designs of padlock passthroughs typically leave the padlocks exposed and protruding outside of the case, making the padlocks susceptible to damage during transport or storage. Such placement of the padlock outside of the firearm case may also cause the padlock to rattle and/or damage objects in the vicinity of the case when the case is being transported. Aspects of the present disclosure are directed to a firearm case utilizing a latch mechanism that: a) prevents the latches from being released from a closed/engaged position when a padlock is in place; and/or b) contains the padlock, when attached to the case, within the case profile (e.g., a front profile). Further details of an exemplary padlock passthrough, in accordance with an embodiment, are described with respect to FIG. 8 below.

Figure 8:
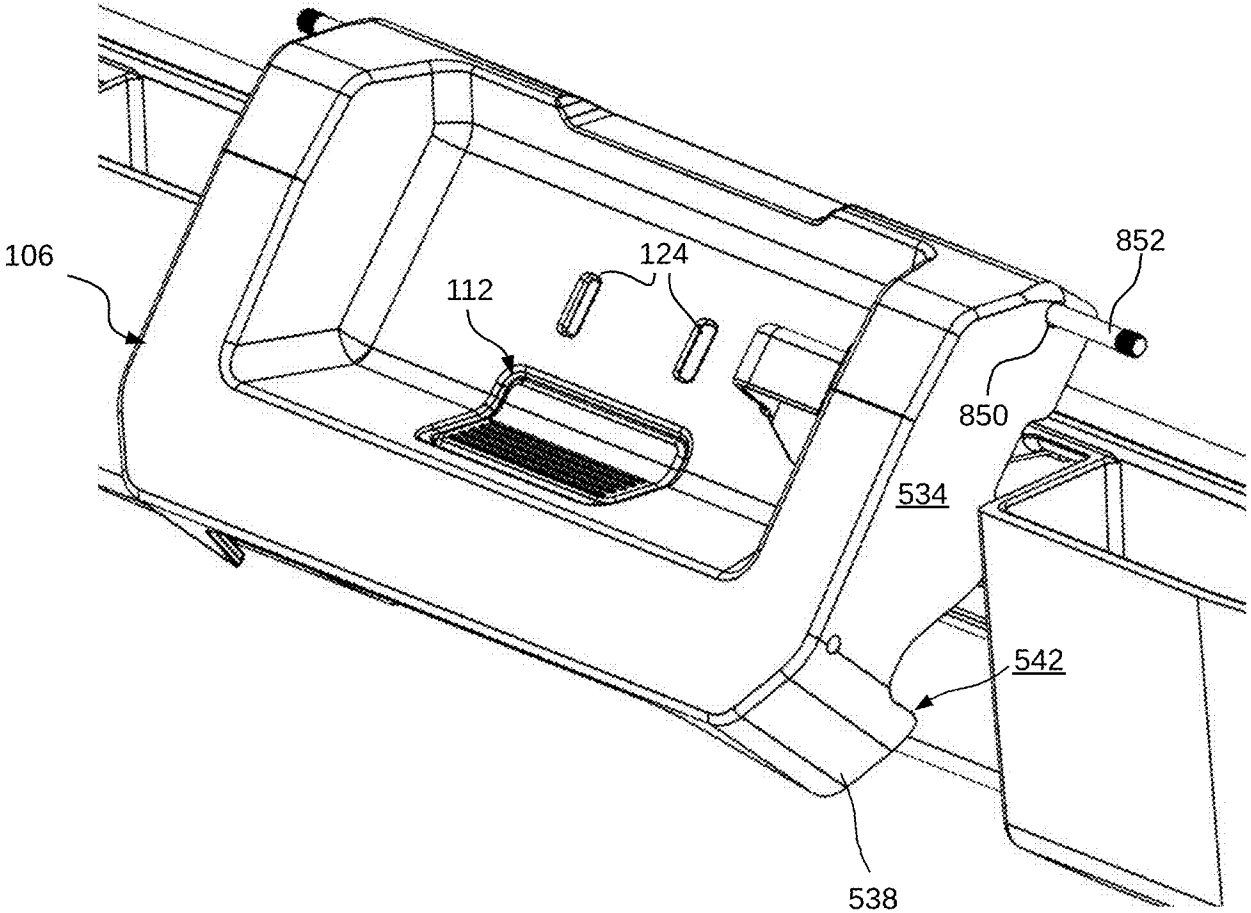
FIG. 8 illustrates a detailed perspective view of latch 106, according to various aspects of the disclosure.

FIG. 8 shows a partial close-up, top view of an area around one of latches 106, in accordance with an embodiment. As shown in FIG. 8, latch 106 includes a passthrough feature 116, including a hole 122 for receiving a lock mechanism, such as a padlock 123 (shown), a zip-tie, a wire, a cable, or another lock. Passthrough feature 116 and hole 122 are configured to cooperate with corresponding features formed into base 102, for instance. In an example, passthrough feature 116 may be positioned to cooperate with a corresponding feature in base 102 such that, when a padlock or another lock mechanism is engaged in hole 122, the lock mechanism is passed through both latch 106 and base 102 and latch 106 is prevented from disengaging. Further details of the corresponding feature in base 102 are discussed with respect to FIG. 18 at an appropriate juncture below. For instance, when a lock mechanism is engaged with passthrough feature 116, the lock mechanism may physically prevent latch 106 from disengaging from base 102 and/or button 112 from being accessible to the user for disengaging latch 106. In some cases, passthrough feature 116 may be positioned within a recessed area of latch 106, wherein the recessed area may be specifically shaped and sized to accommodate a typical padlock. In this way, the padlock or another lock mechanism may be accommodated within a cross-sectional profile of case 100, thus preventing the lock mechanism from snagging on or damaging other objects placed in close proximity with case 100. In some cases, some (i.e., less than half) of the locking mechanism can protrude from the cross-sectional profile of the case 100, though a greater chance of snagging is associated with such dimensions.

Figure 10:
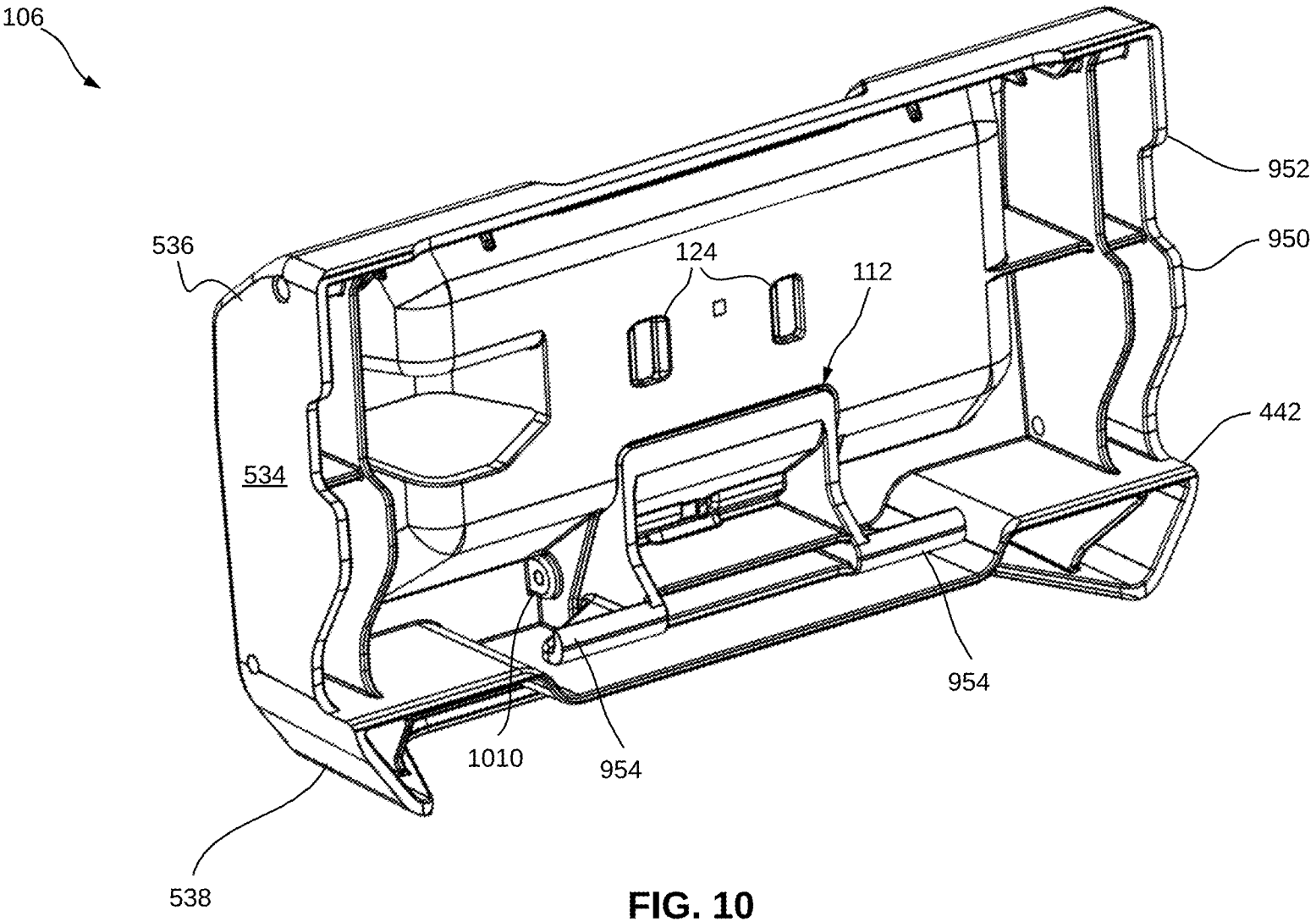
FIG. 10 illustrates a rear perspective view of latch 106, in isolation, in accordance with one or more implementations of the illustrated embodiments.

In some embodiments, latch 106 may include one or more slotted holes 124, for instance, to accommodate one or more elongated lock mechanisms, such as zip-ties, wires, or cables, therein for securing case 100 in a closed position. For example, elongated lock mechanism may be placed through slotted holes 124 and around a lock mechanism, installed into passthrough feature 116, to help prevent the lock mechanism, from snagging/catching on luggage handling equipment, user clothing, or any other obstruction that can remove or damage the lock mechanism. In an embodiment, a sufficient space may be provided behind latch 106 for a zip-tie or similar component to pass through one slotted hole 124 and return through an adjacent slotted hole 124. In an optional embodiment, base 102 or lid 104 may include corresponding openings or features (not shown) aligned with slotted holes 124 such that, when the elongated locking mechanism is directed through one slotted hole and out the other, the elongated locking mechanism also passes through the corresponding openings or features in the base or lid in order to further secure latch 106 form inadvertent disengagement. Although slotted holes 124 are shown in FIG. 2 to have an elongated shape, other shapes, a more symmetric shape such as a circle or square may be implemented. Further details of slotted holes 124, in accordance with an embodiment, are shown in FIG. 10, described at an appropriate juncture below.

Returning to FIGS. 1 and 2, in some embodiments, lid 104 includes one or more channels 114 for accommodating a strap or a belt (e.g., ratchet straps) therein. In an example, these macro-sized channels 114 may keep such straps (not shown) from slipping, migrating, or shifting along case 100 as the case is transported. Whereas prior art cases may include a surface texture intended for preventing slippage of a strap, channels 114 as described herein may provide a more robust engagement surface or interface with the strap. Thus, channels 114 help to reduce slippage of any strap over a wider range of conditions than otherwise would be possible without channels 114, as the strap tension of many straps are known to be affected by, for example, moisture, load shifting, vibration, and dynamic forces encountered while traversing rough terrain.

Figure 3:
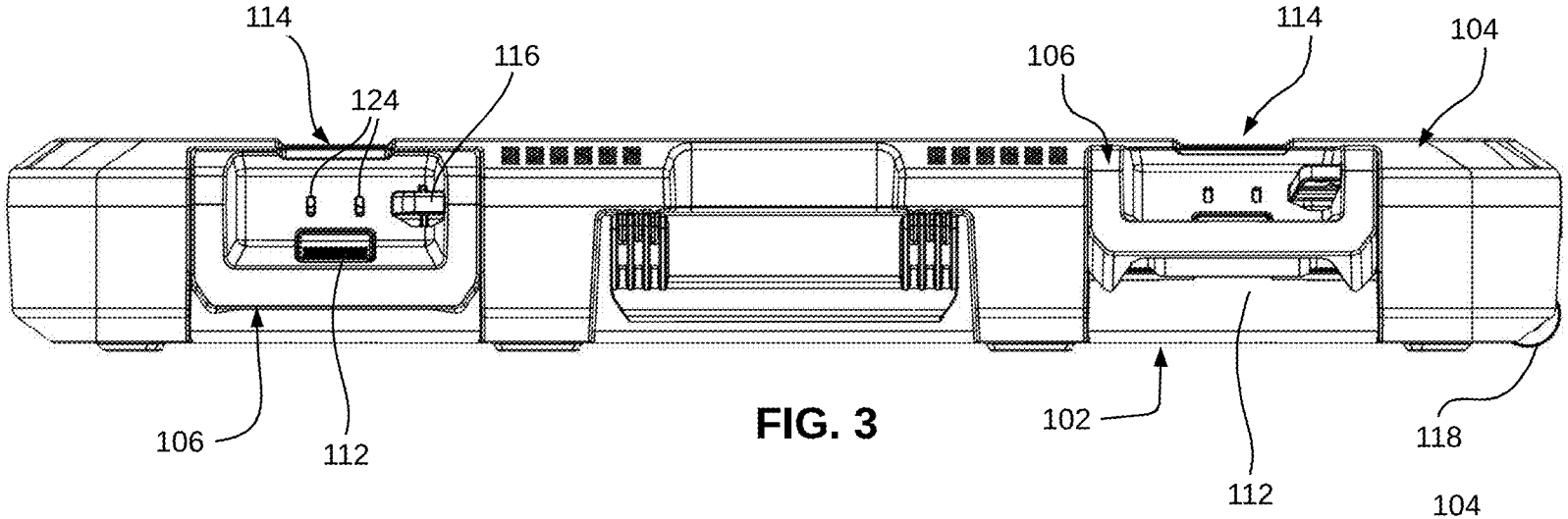
FIG. 3 illustrates a front view of case 100, according to various aspects of the disclosure.
Figure 4:
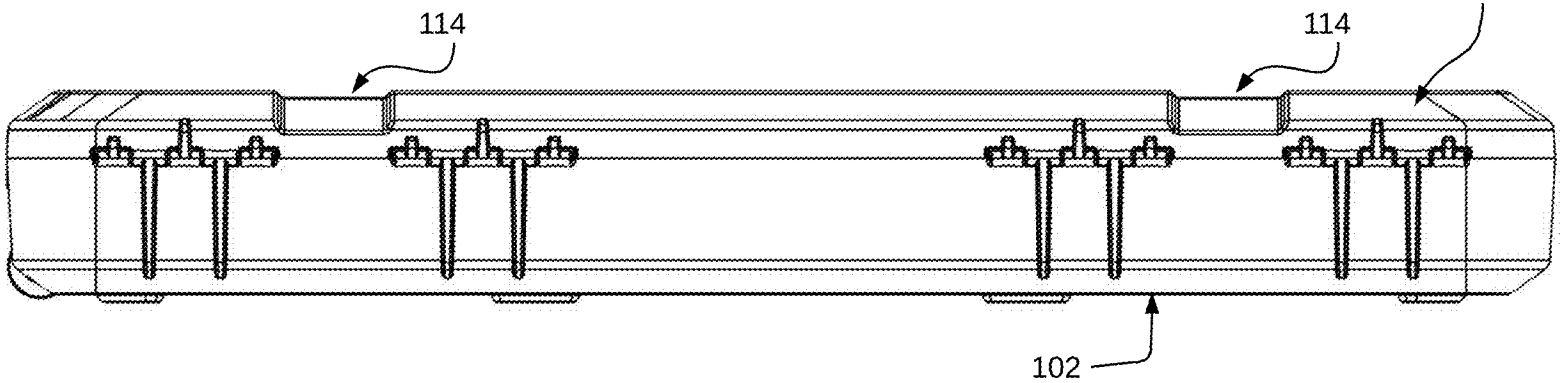
FIG. 4 illustrates a rear view of case 100, according to various aspects of the disclosure.

FIGS. 3 and 4 illustrate front and rear views, respectively, of case 100 of FIGS. 1 and 2, according to various aspects of the disclosure.

Figure 5:
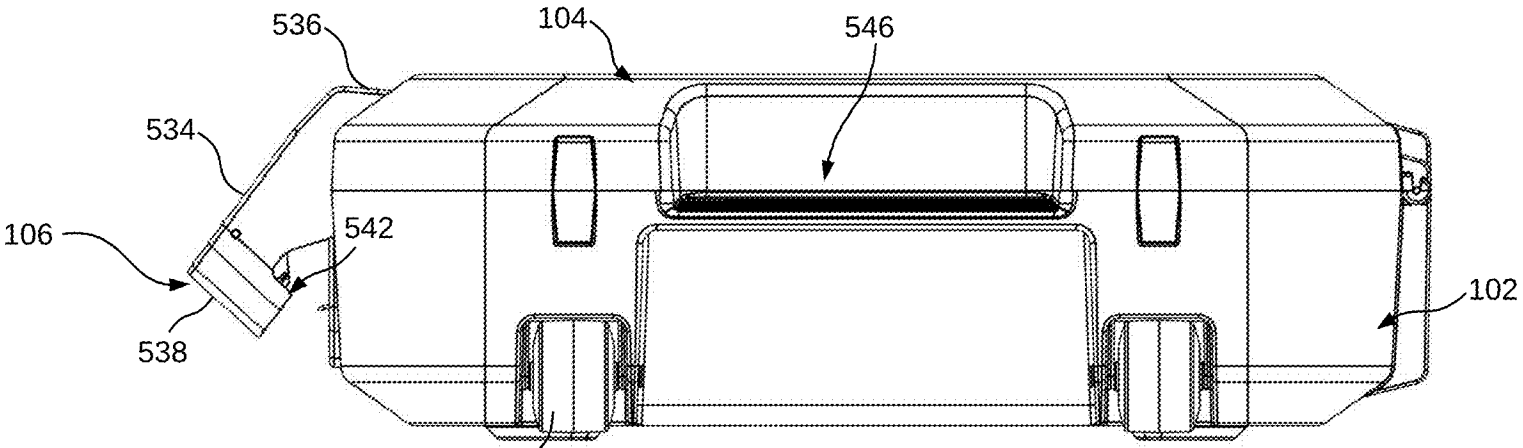
FIG. 5 illustrates a side view of case 100, according to various aspects of the disclosure.
Figure 6:
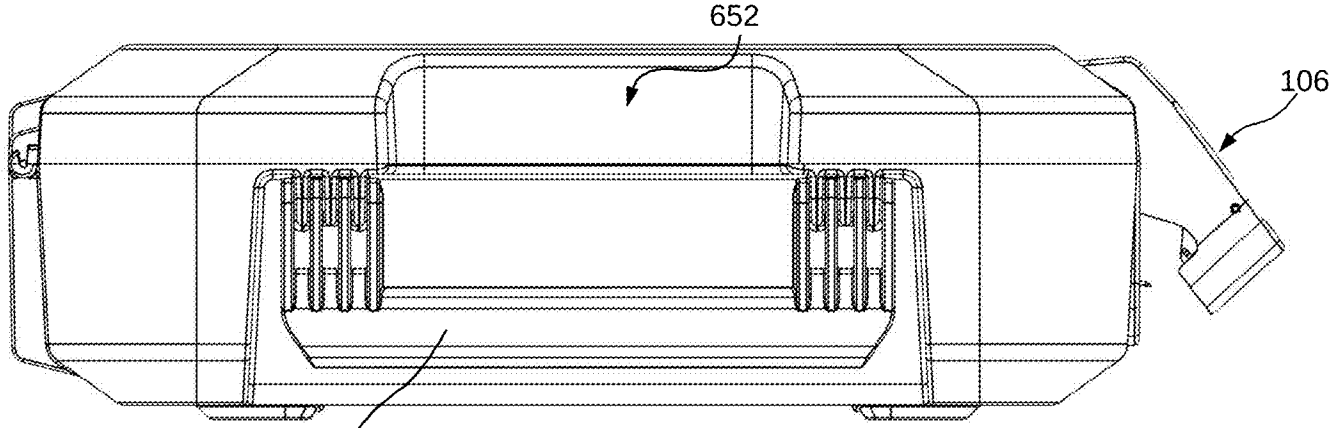
FIG. 6 illustrates an alternate side view of case 100, according to various aspects of the disclosure.

FIGS. 5 and 6 illustrate two different side views along the short edges of case 100, according to various aspects of the disclosure. As is more visible in FIG. 5, latch 106 includes a latch body 534, a first end 536 pivotally coupled with lid 104, and a second end 538 configured for interfacing with base 102 as well as to be gripped by a user in engaging and disengaging latch 106. Second end 538 includes a protrusion 542, which is shaped and size to mate with a protruding edge of base 102 (not visible in FIG. 5). For instance, protrusion 542 may be configured to cooperate with the protruding edge of base 102 to snap latch 106 over the protruding edge when latch 106 is in a closed/engaged position.

FIG. 5 further depicts a wheel-sided handle 546 and exemplary locations of wheels 118 as seen from a wheel-side edge of case 100. As shown in the embodiment illustrated in FIG. 5, wheel-sided handle 546 is integrated with and recessed into case 100 such that, when wheels 118 are placed on the ground, case 100 may be rolled without interference from handle 546. The recessed handle design of wheel-sided handle 546 overcomes a problem with currently available cases, which frequently include a wheel-sided handle that protrudes from the case profile such that then wheel-sided handle must be folded and/or tucked away for the wheels to function properly. Further, the recessed handle design of wheel-sided handle 546 may also provide additional clearance from the ground surface for the case when the case is stood vertically on the wheel-side edge. Additionally, the recessed handle design also enables a sufficiently wide and deep handle for grasping by a user, even if the user is wearing protective gear on their hand.

FIG. 6 shows details of a third handle 650 disposed on an opposing short side of case 100, away from the wheel-side where wheels 118 are located. As shown in FIG. 6, third handle 650 may be formed with a folding design, similar to handle 110 on the long edge of case 100, with sufficient width for comfortable gripping. Further, case 100 may include an optional grip recess 652, again with sufficient width and depth for providing a comfortable space for the user to insert their hand when gripping third handle 650, even while wearing gloves or other protective gear on the hand.

Figure 7:
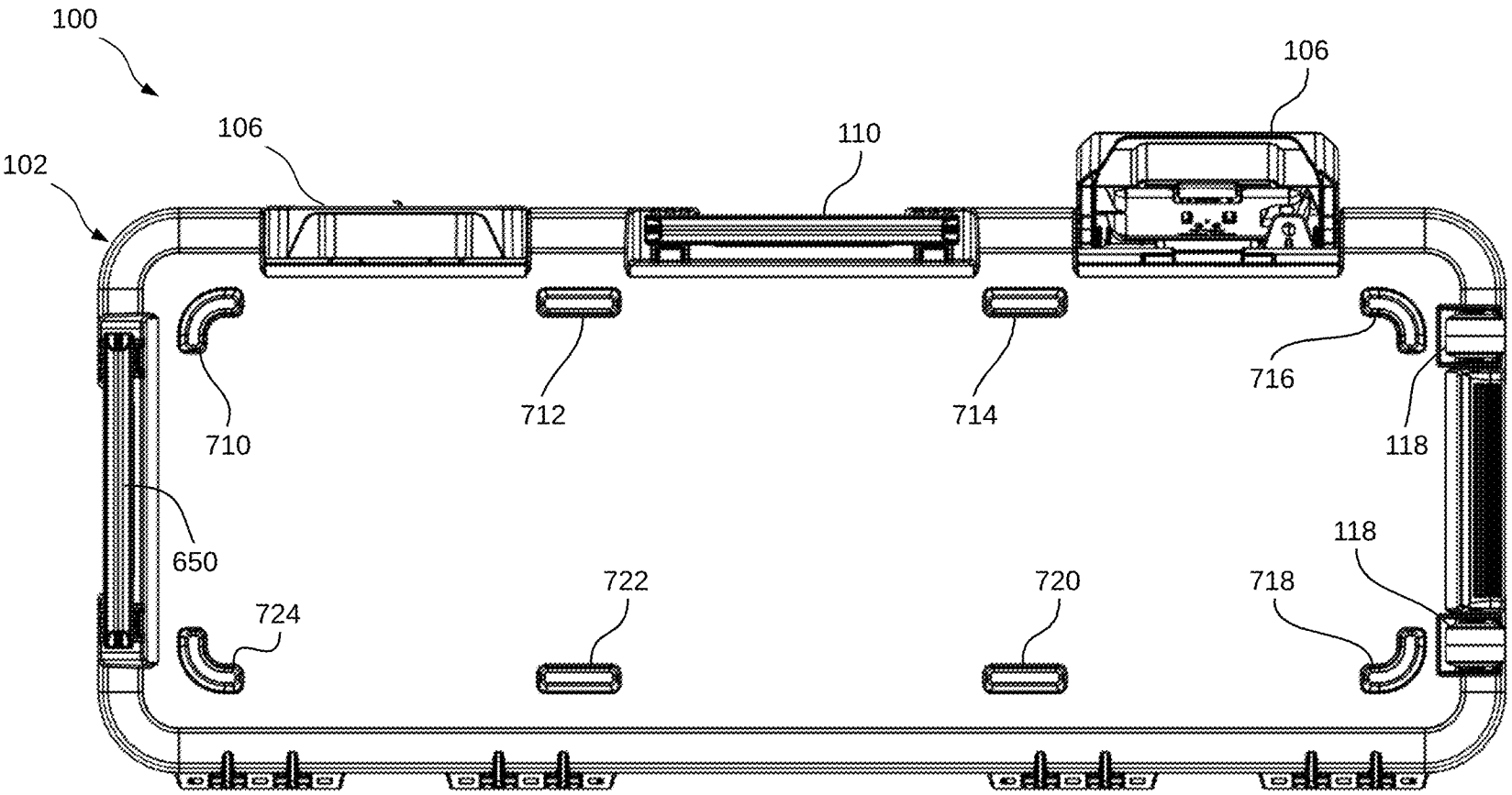
FIG. 7 illustrates a bottom view of case 100, according to various aspects of the disclosure.

FIG. 7 illustrates a bottom view of case 100, according to various aspects of the disclosure. As is visible in FIG. 7, base 102 includes a plurality of bosses 710-724 (eight bosses are shown in the example illustrated in FIG. 7) arranged to cooperate with ridge features 125 on lid 104 (see, for example, FIGS. 1 and 2) such that bosses 710-724 fit atop each other to prevent snugly against ridge feature 125 of a second case when the cases are stacked the top-placed case from moving laterally with respect to the bottom-placed case.

FIG. 8 illustrates a detailed perspective view of latch 106, according to various aspects of the disclosure. The lid is hidden in FIG. 8 to better illustrate the interaction of latch 106 with the internal mechanisms of the lid. As can be seen in FIG. 8, latch 106 includes a hole 850 on each side of first end 536 for receiving a rod or pin 852 such that latch 106 is rotatably coupled with the lid (not shown) via pin 852. In an example, latch 106 may be configured to rotate or pivot about pin 852, where one end of pin 852 is received in hole 850 of first end 536, while the other end of pin 852 is received in a receiving hole in the lid (not shown).

Figure 9:
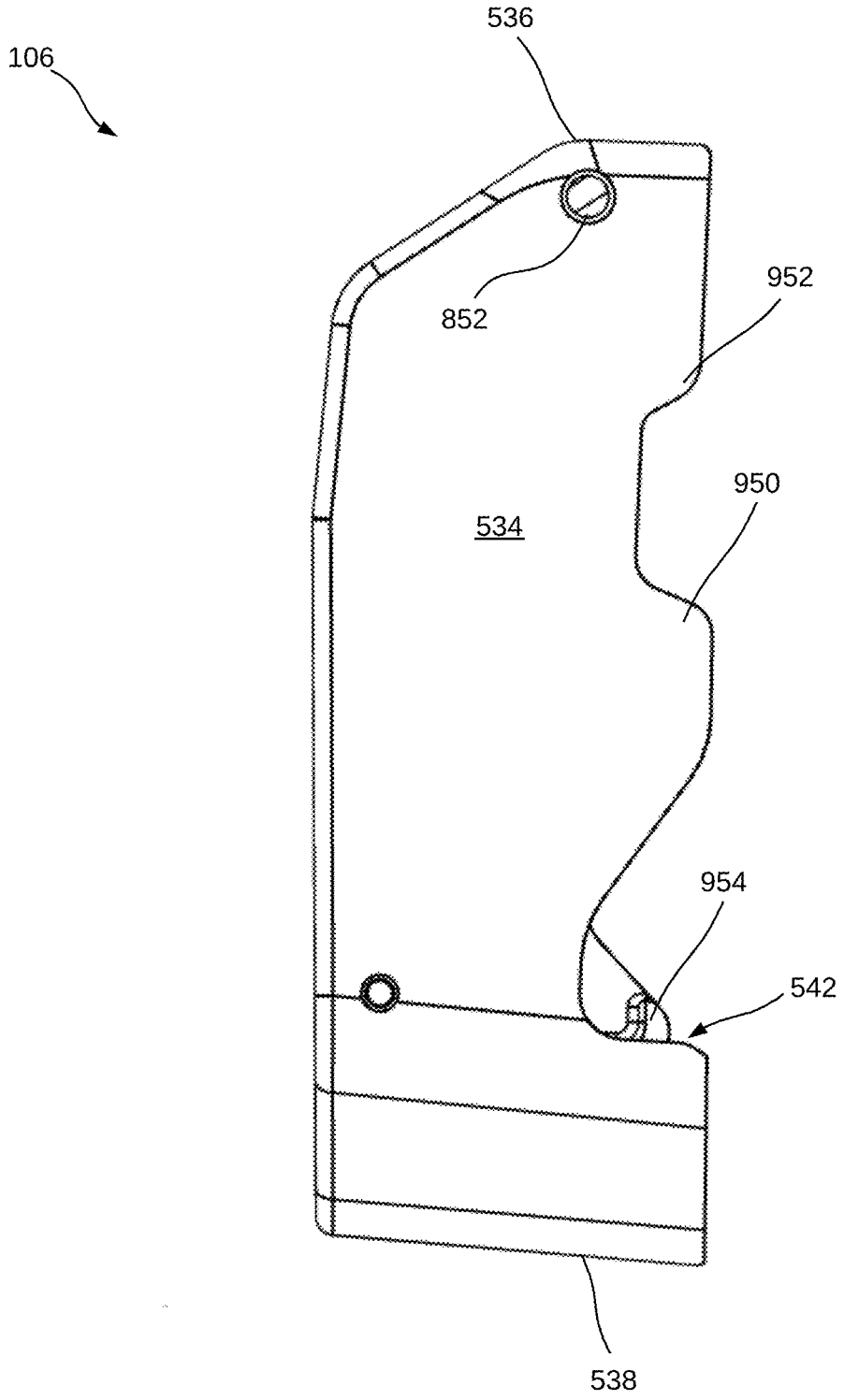
FIG. 9 shows a side view of latch 106 in isolation, in accordance with one or more implementations.

FIG. 9 illustrates a side view of latch 106 in isolation, in accordance with one or more implementations. Latch body 534 of latch 106 includes one or more inward protrusions or detents for engaging with at least one mating retention feature, such as a protruding edge, on base 102 or lid 104 of case 100. In the exemplary embodiment illustrated in FIG. 9, latch body 534 includes, in addition to protrusion 542 discussed above, a second protrusion 950 and a third protrusion 952. Protrusion 542, as discussed above, may be configured to cooperate with a protrusion feature on base 102 (not shown) to snap latch 106 into a closed position when engaged. Second and third protrusions 950 and 952 may provide similar snap-fit functionality, assist with the guiding of latch 106 into place with respect to base 102, or simply provide additional strength and stability to latch 106.

Also in FIG. 9, the backside of button 112 (see, for example, FIGS. 1, 2, and 6 discussed above) includes a hook 954 for engaging base 102 (e.g., see FIGS. 11 and 12 below), separately from latch 106, when lid 104 is in a closed position with respect to base 102. That is, hook 954 of button 112 may optionally engage base 102 to keep case 100 closed even while latch 106 is has started to open (e.g., see FIG. 11 below). In some cases, hook 954 may be spring-loaded (see, for example, the torsion spring shown in FIG. 16 below) and may be biased to rotate toward base 102 (i.e., counterclockwise or upward as shown in FIG. 7) into a closed position to reduce the amount of force required to engage latch 106 with base 102. Hook 954 may be further rotated against the bias by contact with base 102 as latch 106 is being engaged, then rotate back into a locked position once latch 106 is fully engaged with base 102. Optionally, a user may control the movement of spring-loaded hook 954 by pushing on button 112. For instance, to open case 100 after disengaging latches 106, the user may be required to push on button 112 to force hook 954 to rotate in a clockwise or downward manner, thus disengaging hook 954 from base 102 and enabling the user to pull lid 104 away from base 102. Such a two-step case opening process may provide further additional security from the case being opened unintentionally. The mechanism of this action will be described in further detail with respect to FIG. 11 below.

FIG. 10 shows a rear view of latch 106, in isolation, in accordance with one or more implementations of the illustrated embodiments. As can be seen in FIG. 10, button 112 includes one or more hooks 954 for engaging with base 102 when latch 106 is fully closed. Button 112 may be, for example, separately formed from the rest of latch 106, then attached to latch 106 via a tab 1010 configured for cooperating with a notch (not visible in FIG. 10) in button 112 for rotatably coupling button 112 with latch 106. In an embodiment, button 112 may be spring-loaded with a spring (not shown) to bias button 112 in a particular orientation, such as to keep hooks 954 biased to engage with base 102 when button 112 is not depressed by a user.

Figure 11:
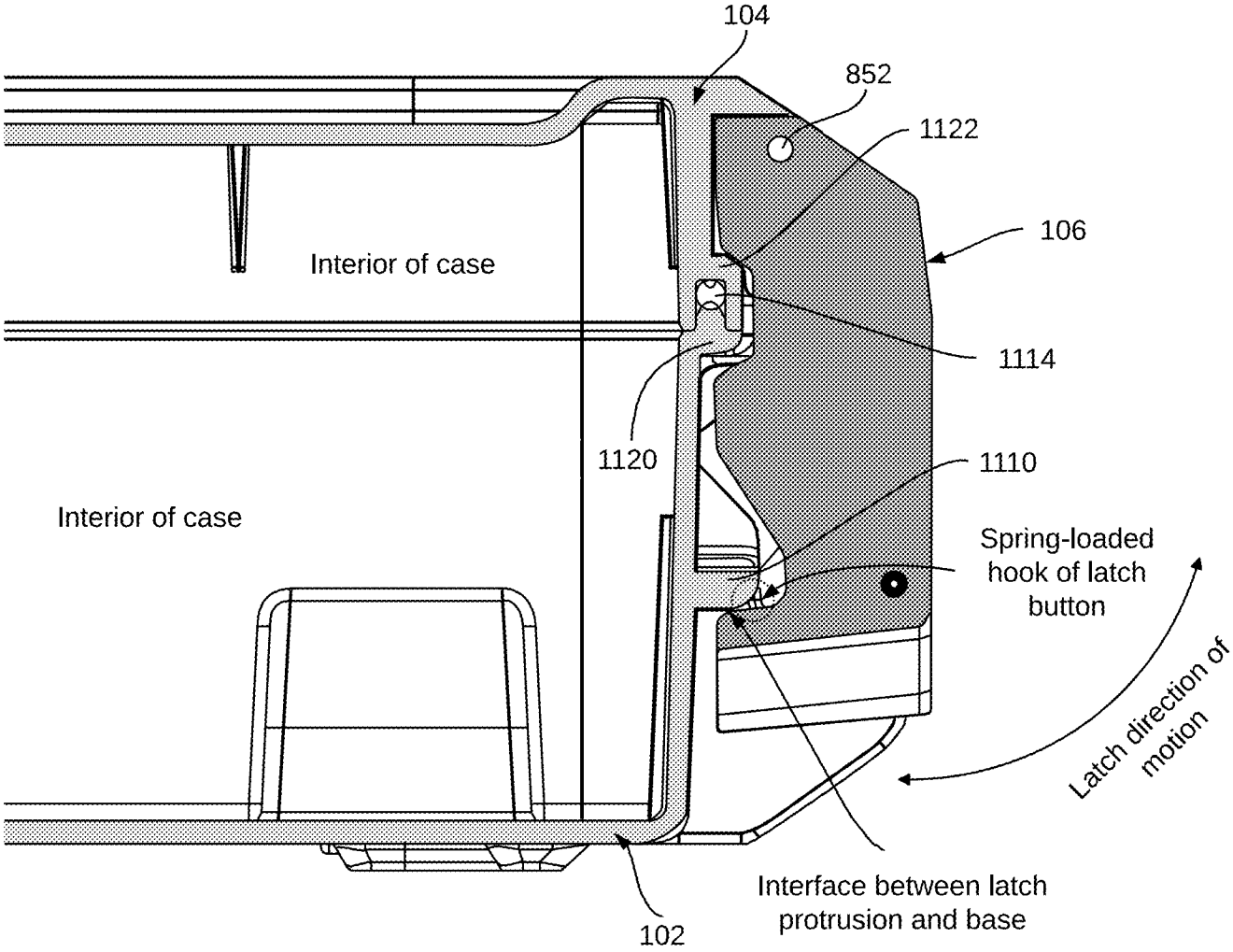
FIG. 11 depicts a side, partial cross-sectional view of the assembled case 100 with a side view of latch 106, shown here to illustrate the operations of the engagement and disengagement of latch 106, in accordance with an embodiment.

FIG. 11 depicts a side, partial cross-sectional view of the assembled case 100 with a side view of latch 106, shown here to illustrate the operations of the engagement and disengagement of latch 106, in accordance with an embodiment. As can be seen in FIG. 11, latch 106 is pivotally coupled with lid 104 via pin 852 to be able to swing open and closed in the latch direction of motion, indicated as a double-headed arrow. In an example, when latch 106 is rotated clockwise, second end 538 of latch 106 contacts a shelf 1110 protruding from base 102 to provide a frictional contact of latch 106 with base 102. In an embodiment, second end 538 may include a lip feature configured to snap onto shelf 1110.

Further, as latch 106 is further rotated in the clockwise direction, hook 954 of button 112 may be configured to engage with a corresponding feature (not shown) formed on base 102. As discussed above, hook 954 may be spring-loaded to bias hook 954 to remain engaged with the corresponding feature until button 112 is depressed to release hook 954 from the corresponding feature. In some cases, the user must depress button 112 to release hook 954 before latch 106 may be disengaged from base 102. In other words, opening the latch 106 may require (1) sufficient torque to overcome a friction fit or snap fit between the lip feature of second end 538 and the shelf 1110 as well as (2) depression of the release button 112 such that the release hook 954 disengages from the base 102.

Optionally, a gasket 1114 may be incorporated or integrated into at least a portion of one or both of base 102 and lid 104. Such a gasket may provide a water-tight and weather-resistant seal when base 102 and lid 104 are engaged together using latch 106 to prevent moisture permeation into and out of the interior or case 100. As an option, second protrusion 950 and optionally third protrusion 952 on latch 106 may be configured to interface with a protruding edge 1120 on base 102 and a protruding edge 1122 on lid 104 to further apply a closing force between base 102 and lid 104 to compress gasket 1114. This compression of gasket 1114 may further enhance the seal provided by gasket 1114. In the embodiment shown in FIG. 11 this compressive force is provided by both the second and third protrusions 950 and 952, though in other embodiments, the second or third, but not both, protrusions 950 and 952 could provide this compressive force (e.g., see FIG. 26, where the indicated interface between latch protrusion and base applies the compressive force on gasket 1114). In some embodiments, a passive pressure equalization element, such as a valve or a vent (not shown), may be integrated into case 100 for regulating pressure gradients between the interior of case 100 and the external atmosphere during transport between different elevations.

In an embodiment, base 102 and/or lid 104 may be constructed of a double wall design, where an outer wall of case 100 exhibits a continuous form with a smooth and streamlined design. Such a continuous form mitigates issues seen in currently available firearm cases, which often include interrupted outer surfaces, which tend to snag on surrounding items and/or collect dirt and debris therein.

Further, third protrusion 952 and protruding edge 1122 on lid 104 may be configured to provide an intermediate point between the latched (i.e., fully engaged) and unlatched (i.e., fully disengaged) positions. For instance, after a user has depressed button 112 to release hook 954 from base 102, a frictional interaction between third protrusion 952 and protruding edge 1122 may prevent latch 106 from immediately opening—for instance, where latch 106 only moves a few millimeters toward an open position. At this point, the user may be required to apply an extra pulling force (e.g., a force exceeding a pre-defined threshold frictional force present between third protrusion 952 and protruding edge 1122) to enable third protrusion 952 to clear protruding edge 1122, thus allowing latch 106 to become fully disengaged and enabling the user to open lid 104. Similarly, the user may be required to apply an extra pushing force on latch 106 to enable third protrusion 952 to overcome protruding edge 1122. Such a configuration of third protrusion 952 and protruding edge 1122 may provide a more secure fit of latch 106 onto base 102 and/or prevent unintentional latching or locking of case 100.

Figure 12:
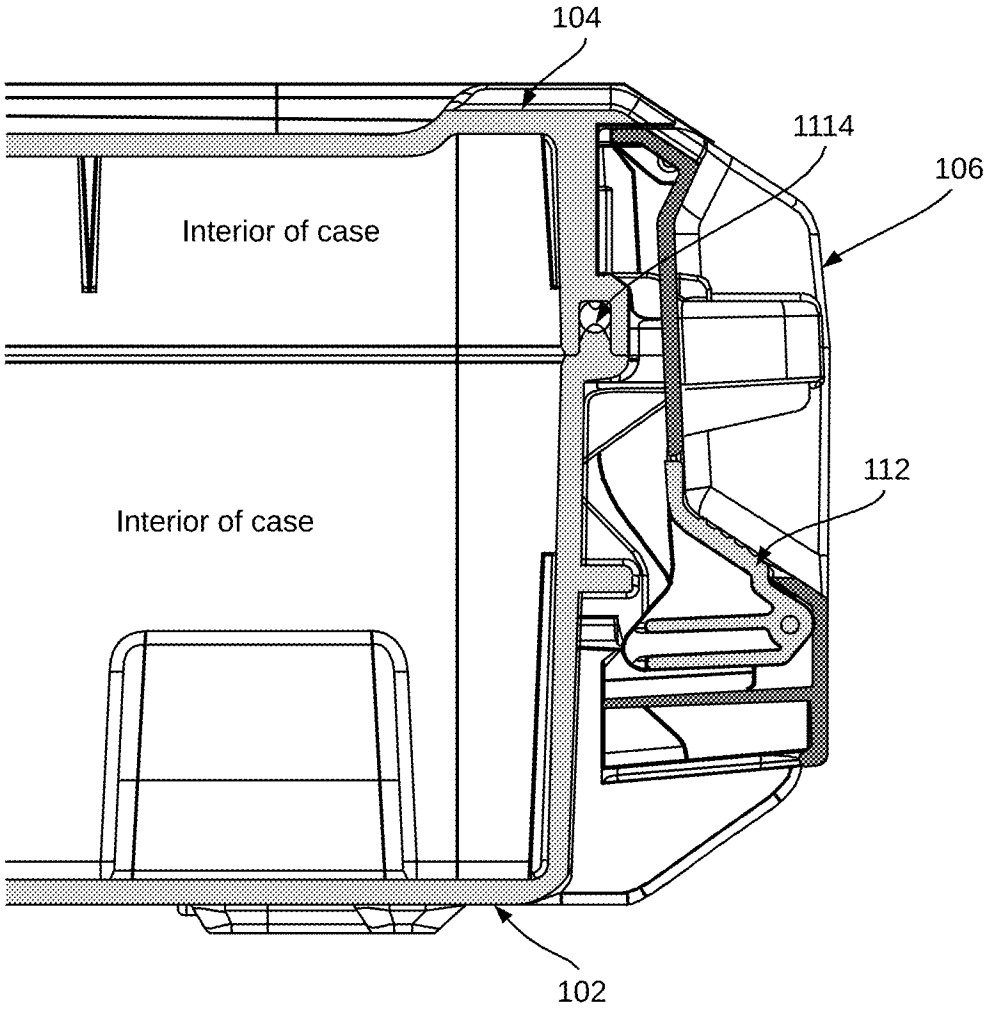
FIG. 12 depicts a side, partial cross-sectional view of the assembled case 100, this time including a cross-sectional side view of latch 106, shown here to illustrate further details of the operation of button 112, in accordance with an embodiment.

FIG. 12 shows a side, partial cross-sectional view of the assembled case 100, this time including a cross-sectional side view of latch 106, shown here to illustrate further details of the operation of button 112, in accordance with an embodiment. It is noted that features visible in FIG. 12 particularly related to the walls of the case and latch 106, including button 112, have been described in detail above with respect to, for example, FIGS. 9 and 10.

Figure 13:
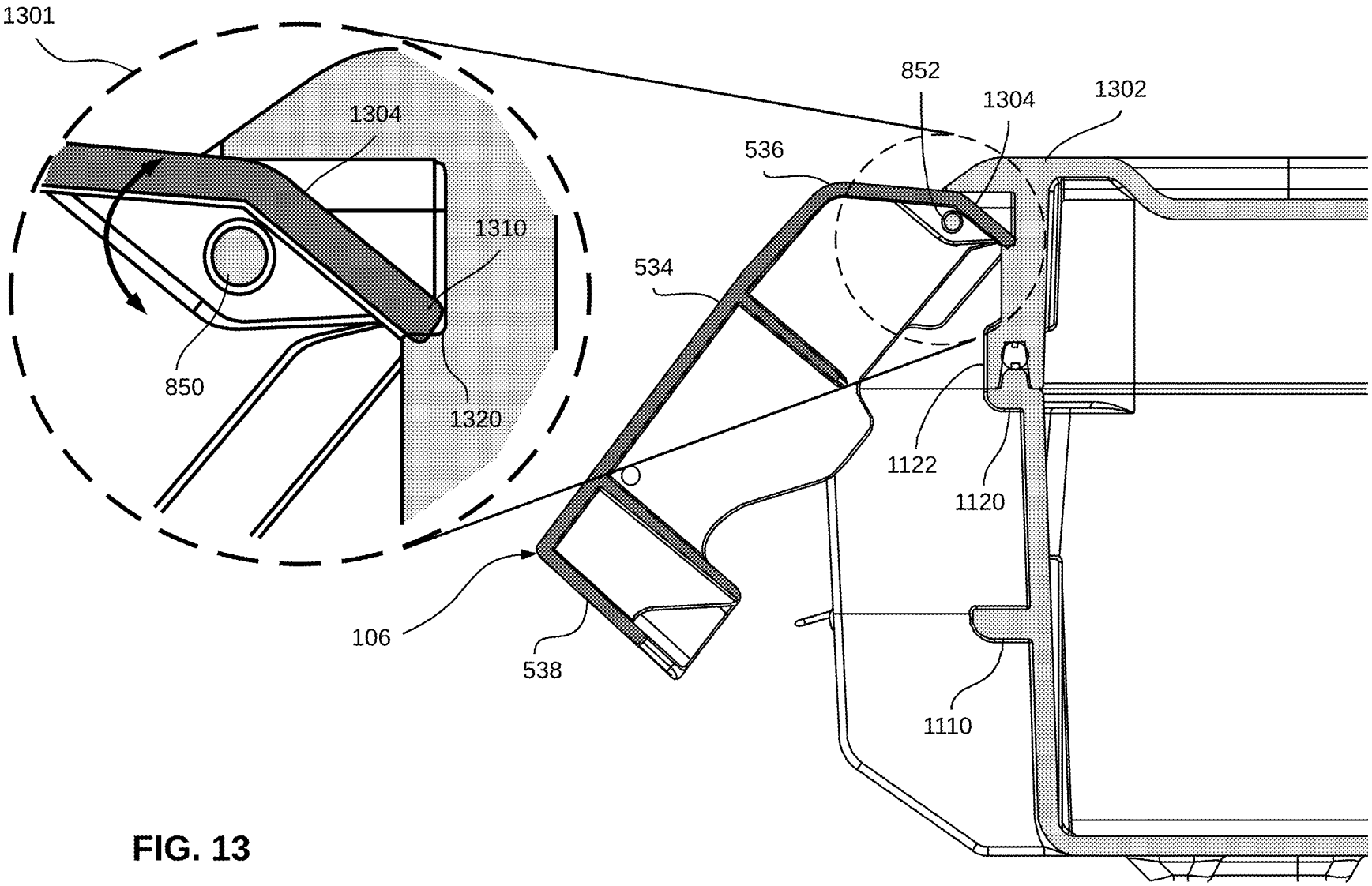
FIG. 13 illustrates another cross-sectional side view and an inset of a portion of case 100, included here to illustrate a detent-open mechanism.

FIG. 13 shows another cross-sectional side view and an inset 1301 of a portion of case 100, included here to illustrate an exemplary embodiment of a detent-open mechanism. In this embodiment, pin 852 is arranged closer to a wall 1302 of lid 104 than a length of a top 1304 of latch 106. Thus, an arc formed by this edge of latch 106 passes through wall 1302. When opening and closing latch 106, this over-center arrangement acts as a detent and either biases latch 106 into a fully-open or optionally a fully-closed position (although this second option is not shown). Such an arrangement is especially useful for the open position, where latch 106 may be held in an open position rather than closing due to gravity. In other words, as latch 106 is disengaged and rotated clockwise in FIG. 13, a tip 1310 of latch 106 becomes caught in a recess 1320 of wall 1302, as shown in closer detail in inset 1301. The arc of movement of tip 1310 causes it to press against wall 1302 and into recess 1320. If sufficient force is applied to latch 106, tip 1310 can be made to slip past recess 1320 by slight deformation of latch 106, pin 852, and/or wall 1302. The sizing tolerances between the various components shown in FIG. 13 may also be specified to enable latch 106 to move past this over-center position between open and closed positions, in certain embodiments.

Figure 14:
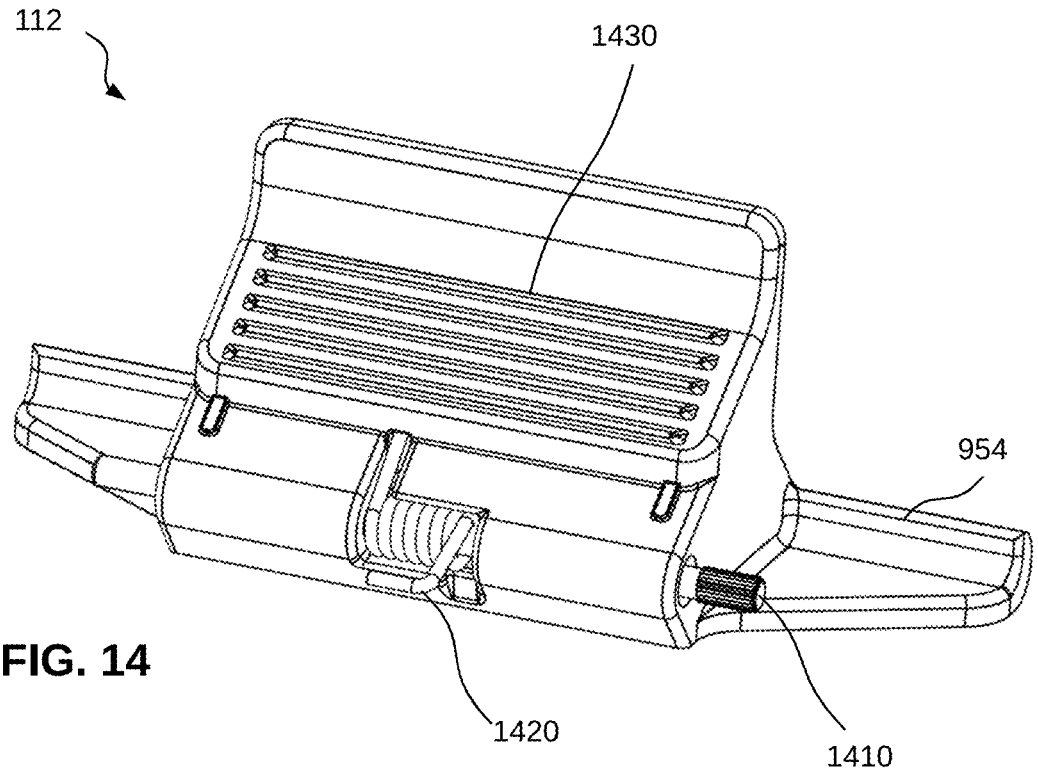
FIGS. 14 and 15 show front perspective and side views, respectively of button 112 in isolation, in accordance with an embodiment.
Figure 15:
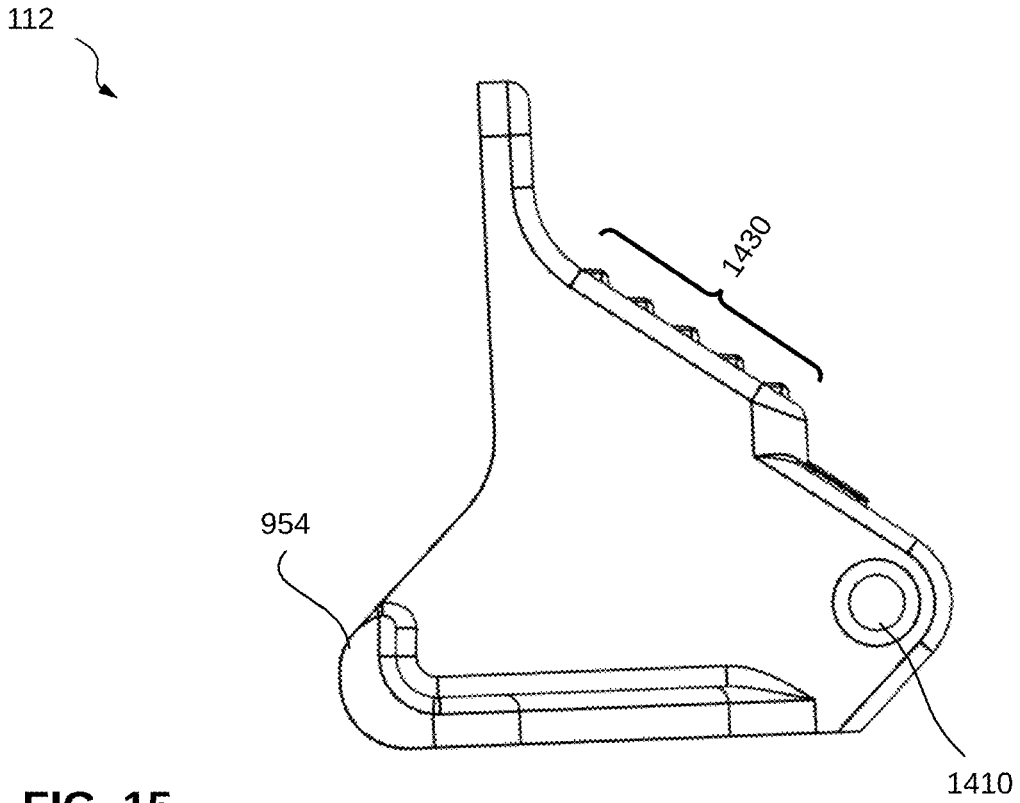

FIGS. 14 and 15 show front perspective and side views, respectively, of button 112 in isolation. As visible in FIG. 14, button 112 includes a latch pin 1410 configured for rotatably coupling with the rest of latch 106, for example via tab 1010 as shown in FIG. 10. A spring 1420 (e.g., a torsion spring) may be integrated into button 112 to bias button 112 to rotate in a clockwise direction as shown in FIG. 15 such that hook 954 is biased to remain in engagement with a corresponding feature in base 102, in accordance with certain embodiments. Optionally, latch pin 1410 and spring 1420 may collaborate to retain button 112 in a coupled configuration within latch 106. Further, as visible in both FIGS. 14 and 15, button 112 may include one or more ridges 1430 for providing improved grip for a user in engaging with button 112.

Figure 16:
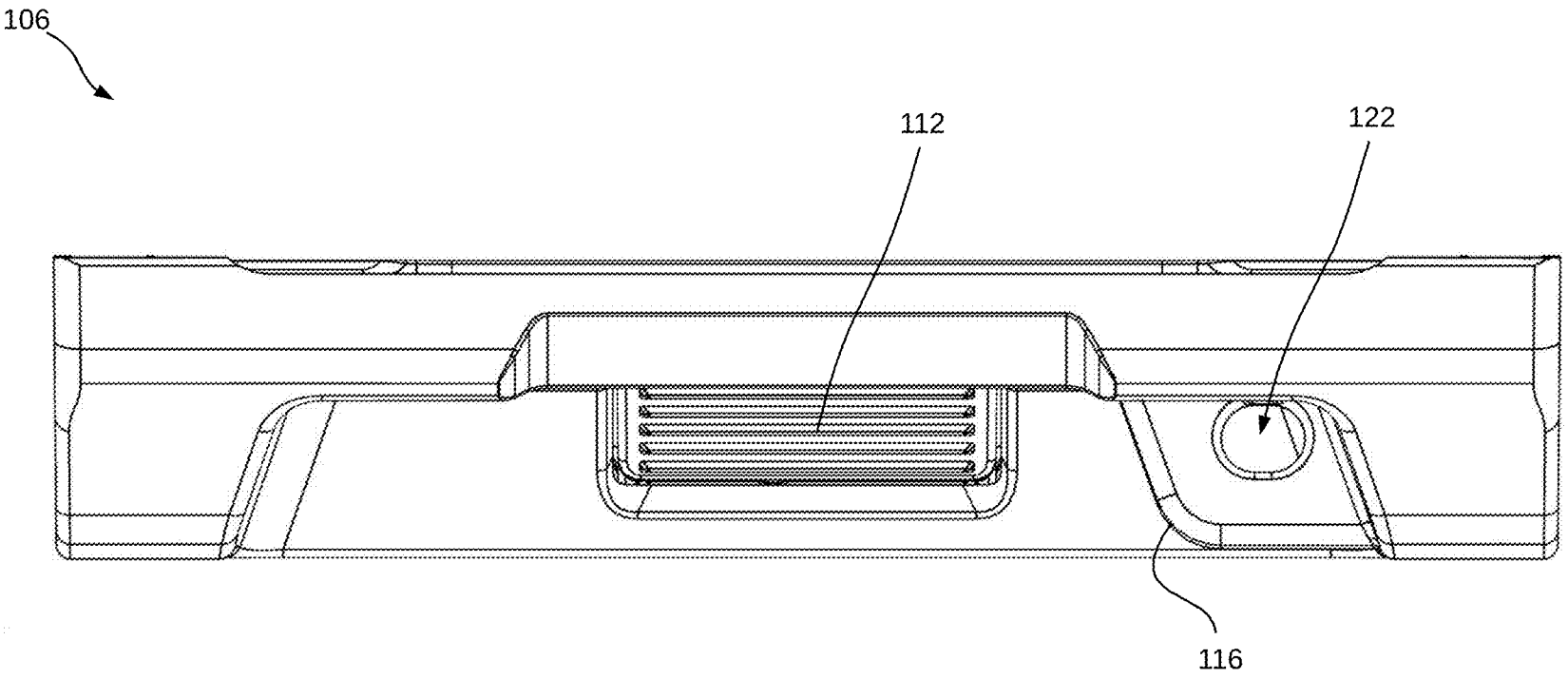
FIG. 16 shows a top close-up view of a portion of case 100 including latch 106.
Figure 17:
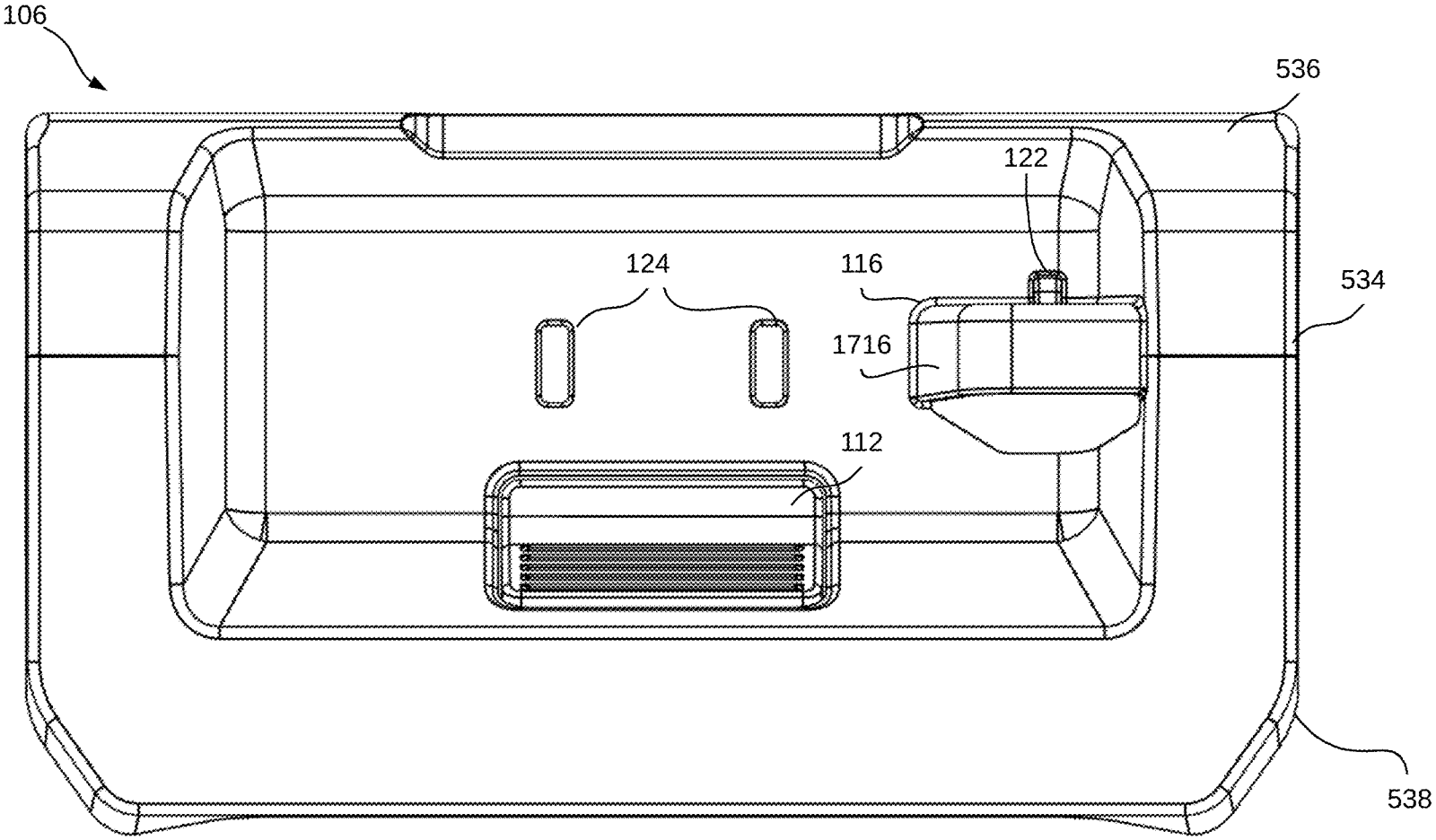
FIG. 17 shows a front close-up view of the portion of case 100 shown in FIG. 16.

FIG. 16 shows a top close-up view of a portion of case 100 including latch 106 (e.g., latch 106 on the left side of case 100 as shown in FIG. 2). Similarly, FIG. 17 shows a front close-up view of the portion of case 100 shown in FIG. 16. As can be seen in FIGS. 16 and 17, latch 106 is configured to enable a user ready access from the front (i.e., latch side) of case 100 to button 112 and passthrough feature 116, which are integrated into latch 106 and configured to cooperate with a protrusion 1716 (including a hole (not visible) aligned with hole 122), in the illustrated embodiment. Further, passthrough feature 116 and hole 122 are configured such that, when a locking mechanism such as a padlock, key lock, zip-tie, wire, or cable has been inserted into hole 122 of passthrough feature 116, and thus the corresponding hole in protrusion 1716, the locking mechanism prevents latch 106 from being opened. That is, while latch 106 and, optionally, button 112 serve to mechanically engage together base 102 with lid 104, the addition of a locking mechanism into hole 122 of passthrough feature 116 prevents disengagement of latch 106 and/or button 112 such that case 100 may not be easily opened.

Figure 18:
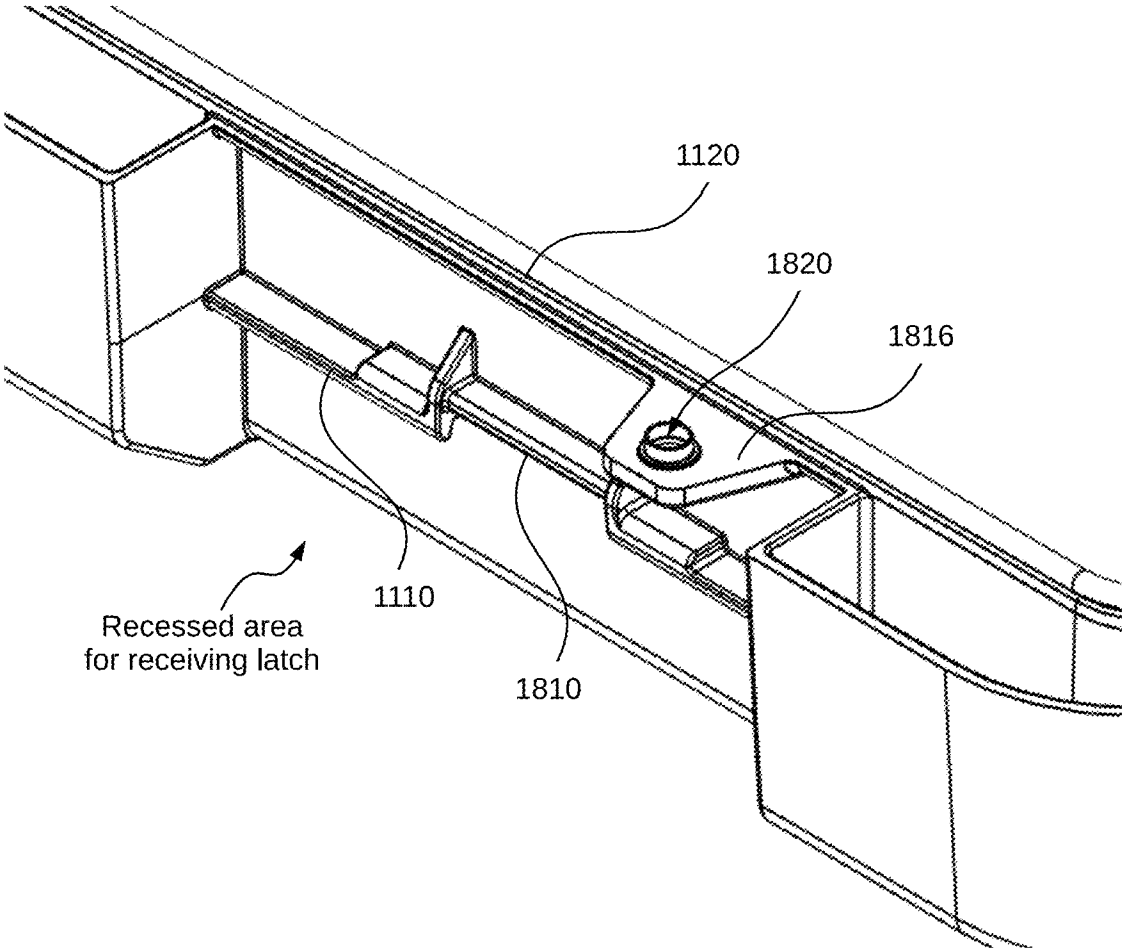
FIG. 18 depicts a front perspective view of a recess in base 102 of case 100 configured to cooperate with latch 106, in accordance with certain embodiments.

FIG. 18 shows a front perspective view of a recess in base 102 of case 100 configured to cooperate with latch 106, in accordance with certain embodiments. In particular, FIG. 18 shows an exemplary configuration of various features (e.g., shelf 1110 and protruding edge 1120 of FIG. 11) that cooperate with protrusions in latch 106. Also, a lip 1810 may be configured to cooperate with hook 954 of button 112 such that hook 954 latches onto lip 1810, according to embodiments. Further, FIG. 18 shows a feature 1816 and hole 1820 for cooperating with corresponding features in latch 106 to enable the use of a locking mechanism (e.g., padlock, key lock, zip-tie, wire, or cable) therein to prevent disengagement of latch 106.

Figure 19:
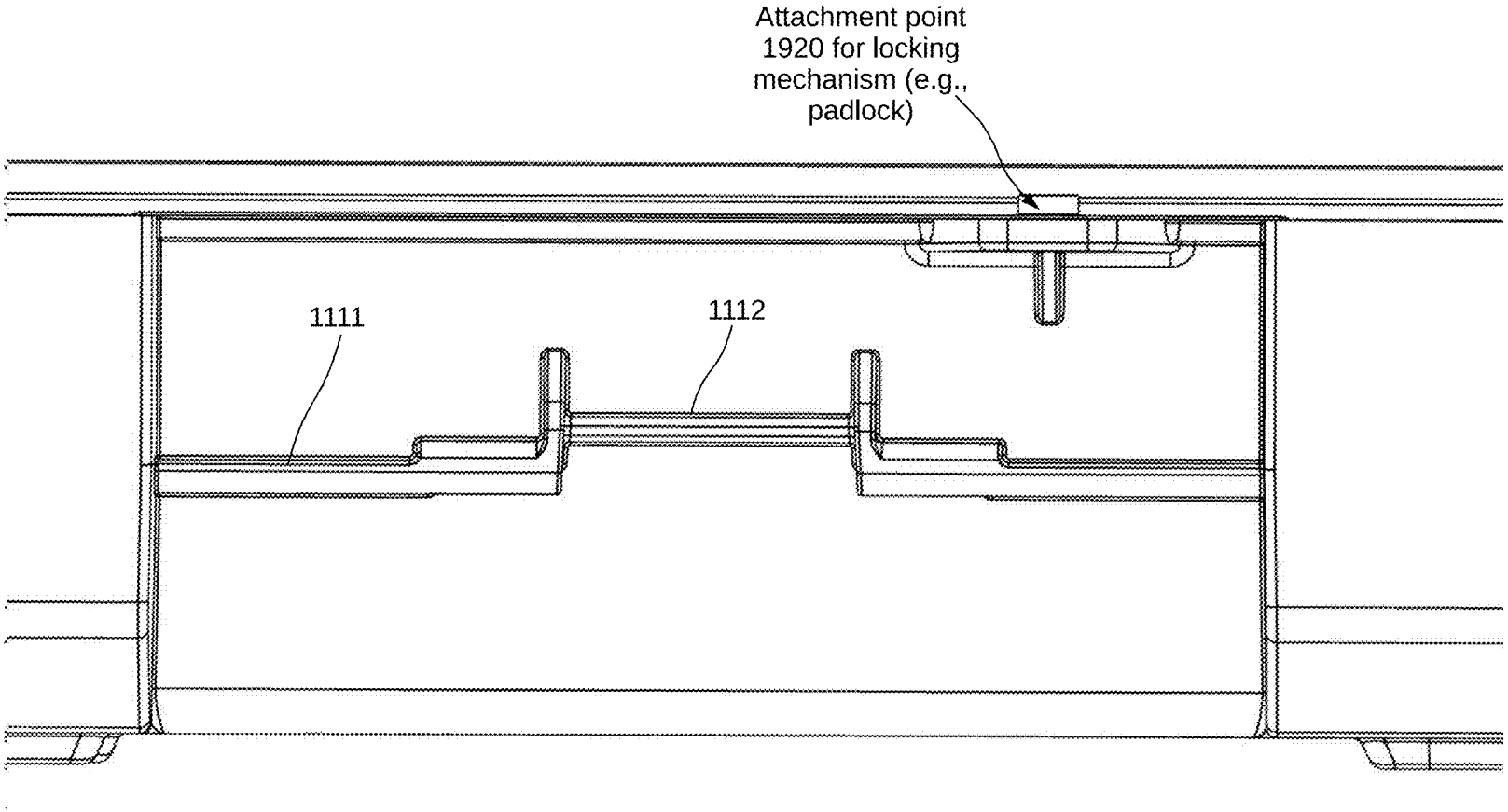
FIG. 19 shows a front view of a similar portion of base 102 as illustrated in FIG. 18, with an alternative configuration of an attachment point for a locking mechanism.

FIG. 19 shows a front view of a similar portion of base 102 as illustrated in FIG. 13, showing an exemplary configuration of an attachment point formed into the base for interfacing with a locking mechanism. Other configurations of attachment points may be contemplated, and other considered part of the present disclosure.

Figure 20:
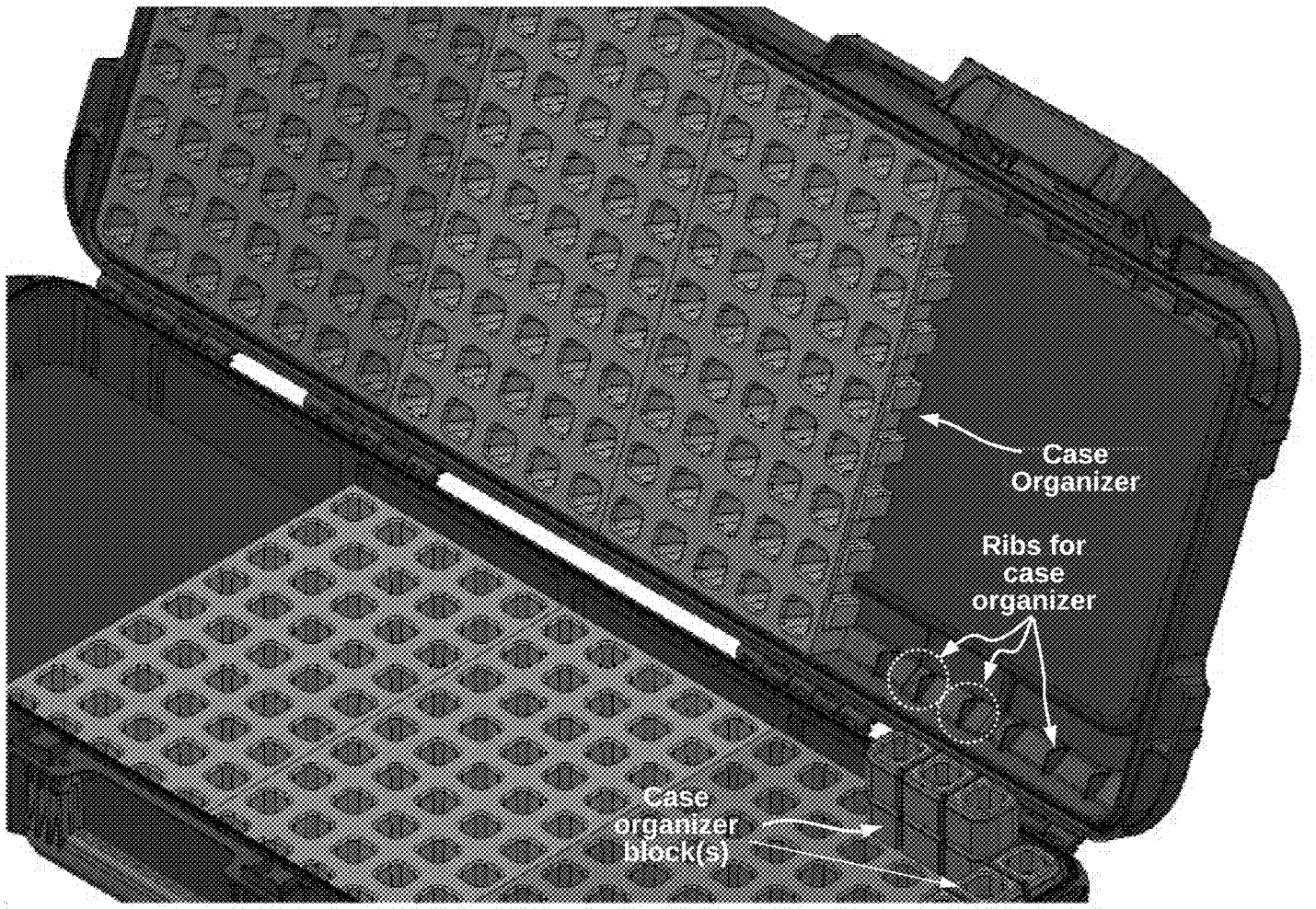
FIGS. 20-22 show optional internal features within case 100, in accordance with certain embodiments.
Figure 21:
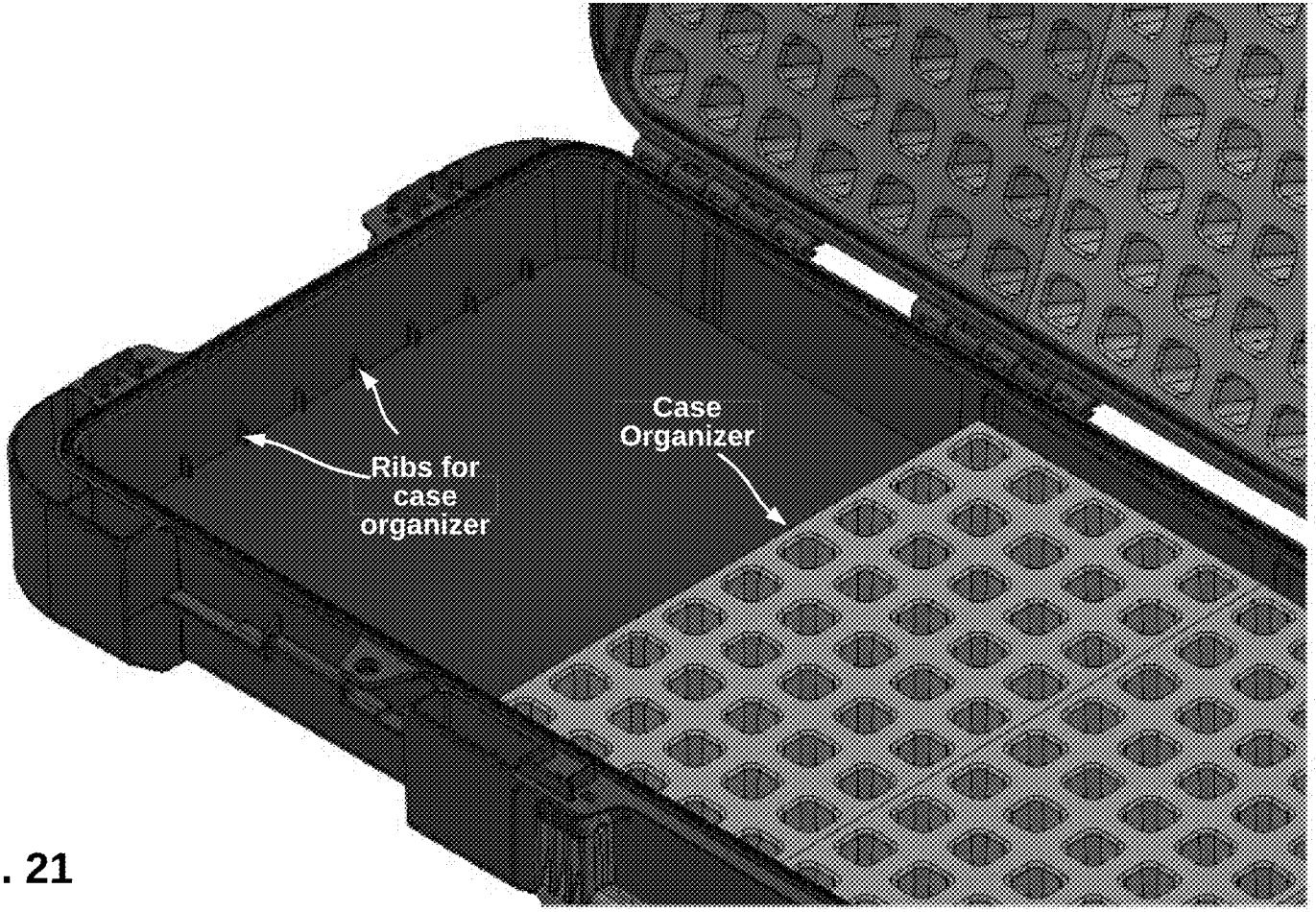
Figure 22:
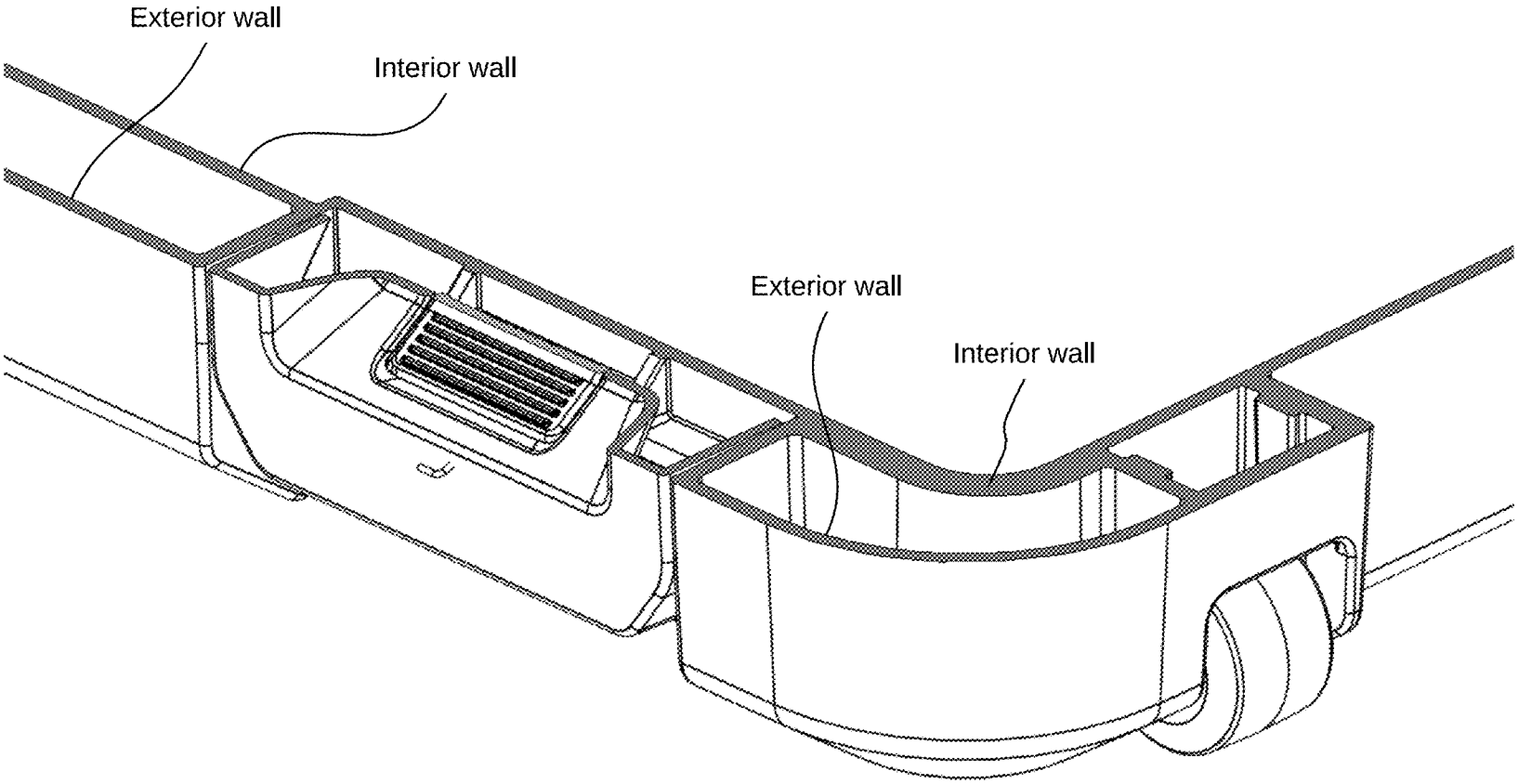

FIGS. 20-22 illustrate optional internal features within case 100. For instance, one or more case organizers with interlocking edges may be used within case 100. Optionally, case 100 may include internal ribs for interfacing with the case organizers to ensure secure retention of the case organizers within the case. For instance, internal ribs may provide frictional forces to retain an internal organization system within the case, especially where the case organizer is made of a malleable material such as an open cell foam. Such internal ribs may be positioned inside base 102 and/or lid 104. Case organizers may be configured as reconfigurable, modular components, and may include a grid of one or more through-holes (or depressions that do not go all the way through) for receiving one or more case organizer blocks therein. These blocks may be arranged around items placed within the case (such as firearms, firearm accessories, musical instruments, scientific equipment, photography equipment, etc.) to prevent these items from shifting within the case during transport, in certain embodiments. Each block may include one or more pegs, each peg configured to enter and form a friction fit within one of the through-holes or depressions. The case organizer may be formed from modular panels of the same or different sizes and configurations allowing customization of the storage solution for a given case and between different sizes and shapes of cases. Additionally, certain portions of the case, such as at the case corners, areas between latches, and the portion into which the wheel is recessed, may be formed of a double-wall construction, including an interior wall and an exterior wall, as shown in FIG. 22 for example. The double-wall construction allows the overall case to have a streamlined profile, with components such as the latches, the wheels, and the handles to be contained within the overall profile of the case and, optionally, to add structural strength to the case in specific areas.

Figure 23:
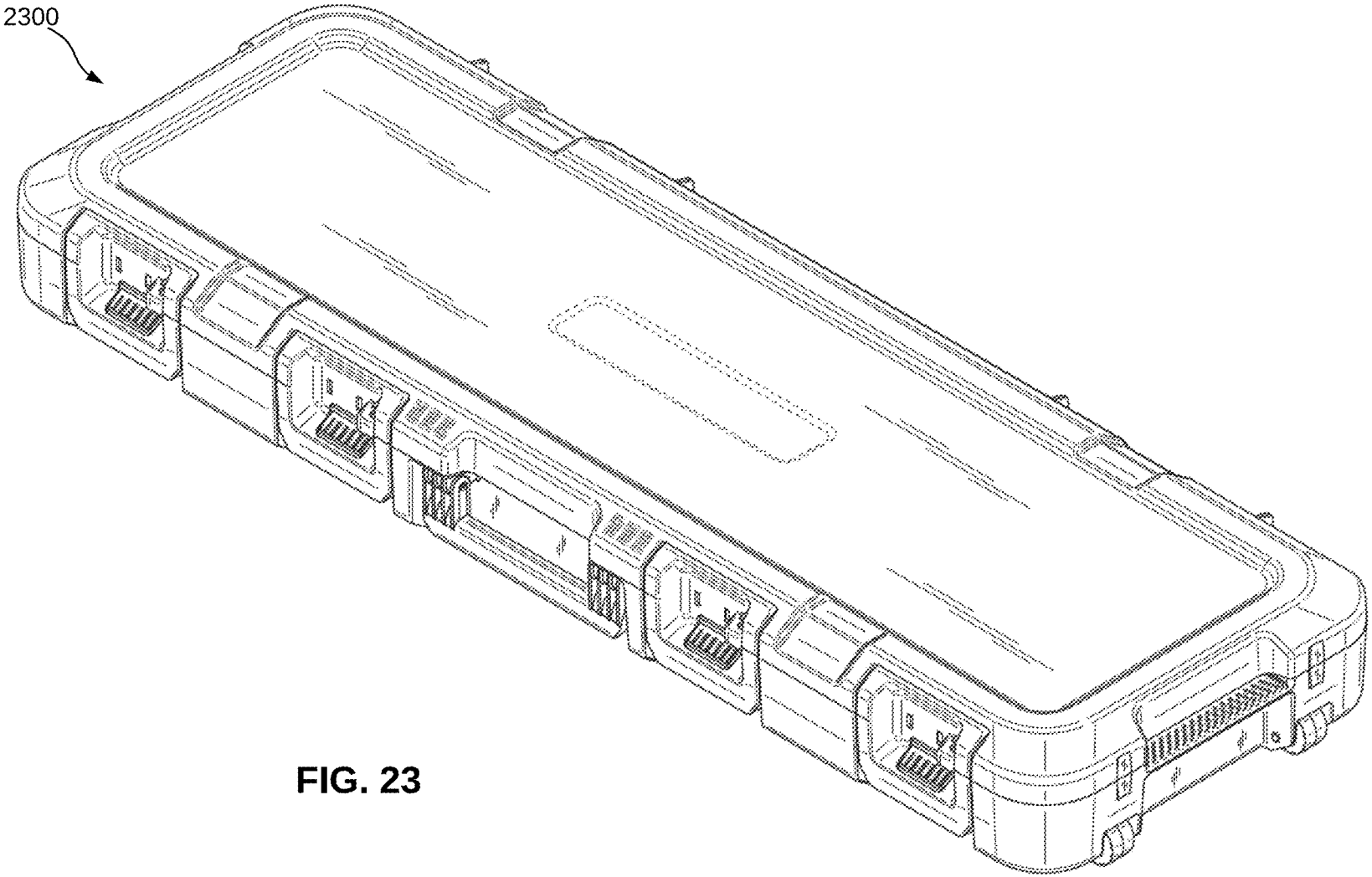
FIGS. 23 and 24 show alternative implementations of a firearm case, in accordance with certain embodiments.
Figure 24:
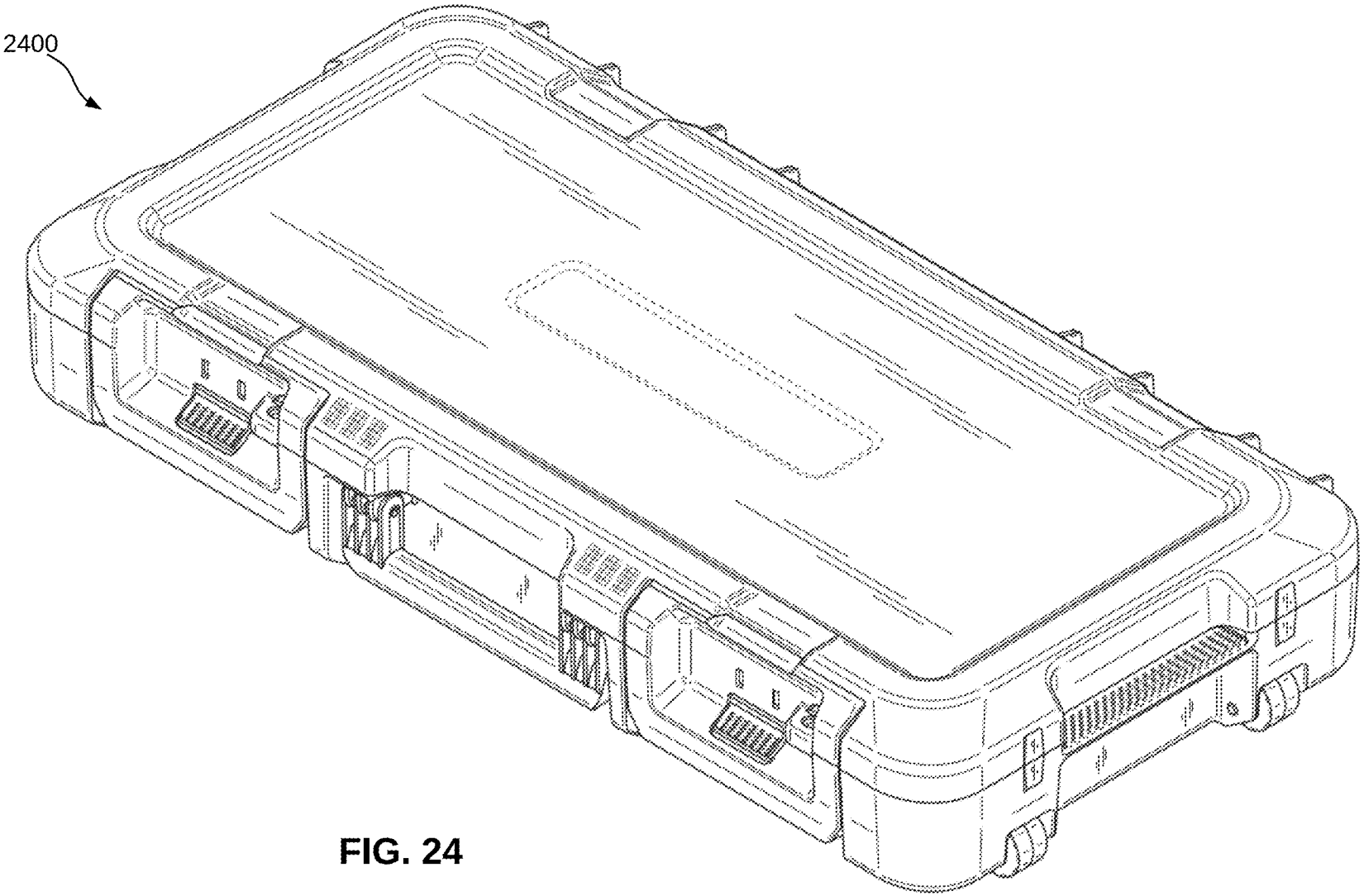

FIGS. 23 and 24 illustrate alternative embodiments of cases, in accordance with certain aspects of the present disclosure. As an example, case 2300 of FIG. 23 includes four latches, which are shorter in width than latch 106 described above. Such an implementation may be advantageous, for example, when the additional security of having more than two lockable latches is desirable despite the smaller latch size, or where a longer case benefits from a greater number of latches. Similarly, case 2400 of FIG. 24 includes a shorter case body compared to case 100 described above, while keeping the various features of case 100, such as the large, securable latches, low profile handles, etc. The smaller case dimensions of case 2400 may be useful for the storage and transport of smaller items, such as handguns or photography equipment. Despite the shorter dimensions of case 2400, the latches therein may have a longer dimension than those used in the longer, case 2300. As discussed above, the exact dimensions, number, material composition, and placement of the latches may be modified according to the specific requirements of the case. For example, in certain embodiments, the latches may be selected, for example, for its size to be able to accommodate a padlock within the latch recess. In other cases, the size of one or more of the latches used with a particular case embodiment may be selected for compatibility with a specific type of locking mechanism, such as a large profile padlock, a keypad, or other apparatus required for a specific use. For instance, certain embodiments may require the integration of a particular type of a lock (e.g., an electronic or biometric lock) that needs to be protected from impact damage during transport. Other modifications are contemplated and are considered a part of the present disclosure.

Figure 25:
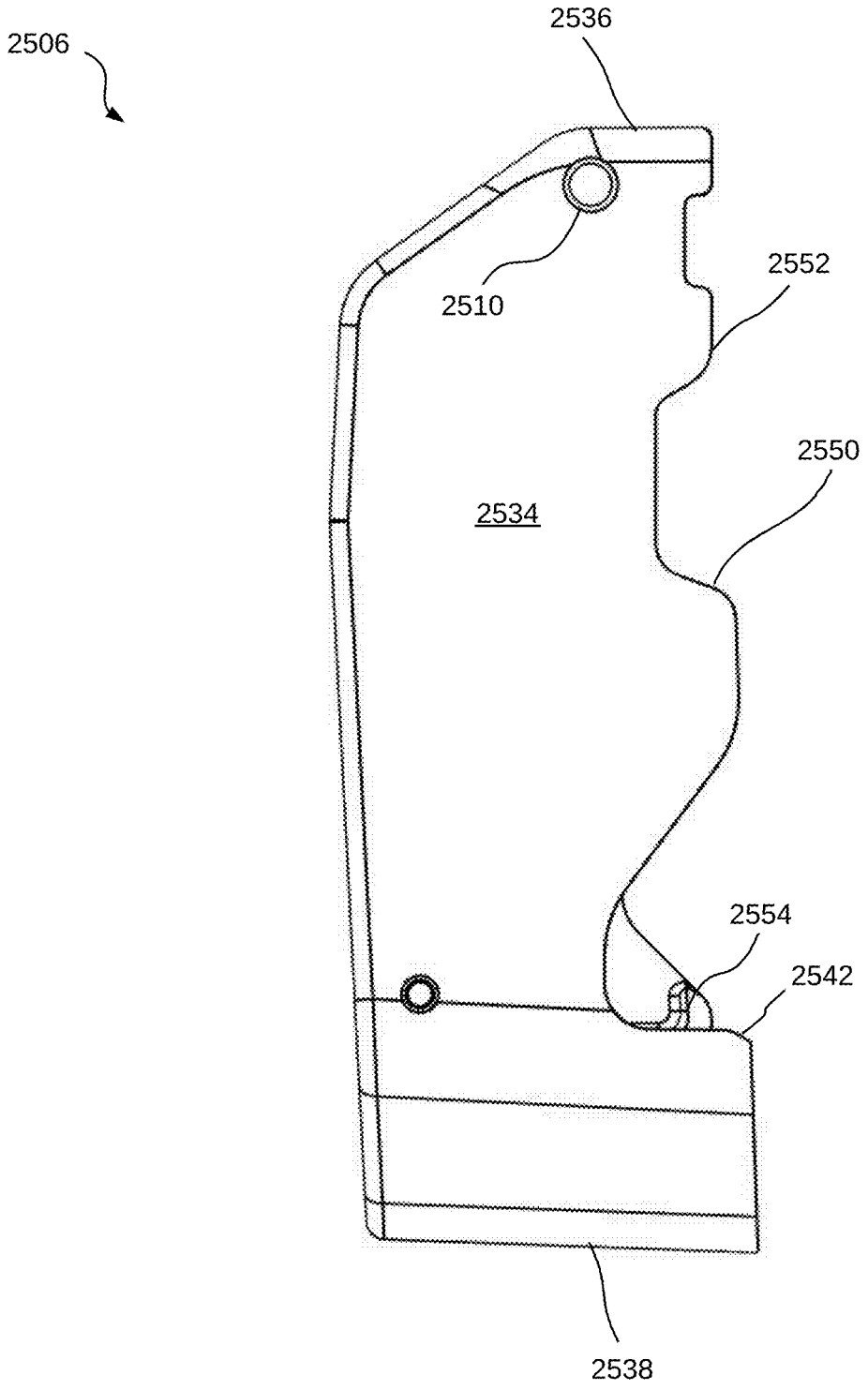
FIG. 25 shows a side view of an alternative configuration of a latch in isolation, in accordance with one or more implementations.
Figure 26:
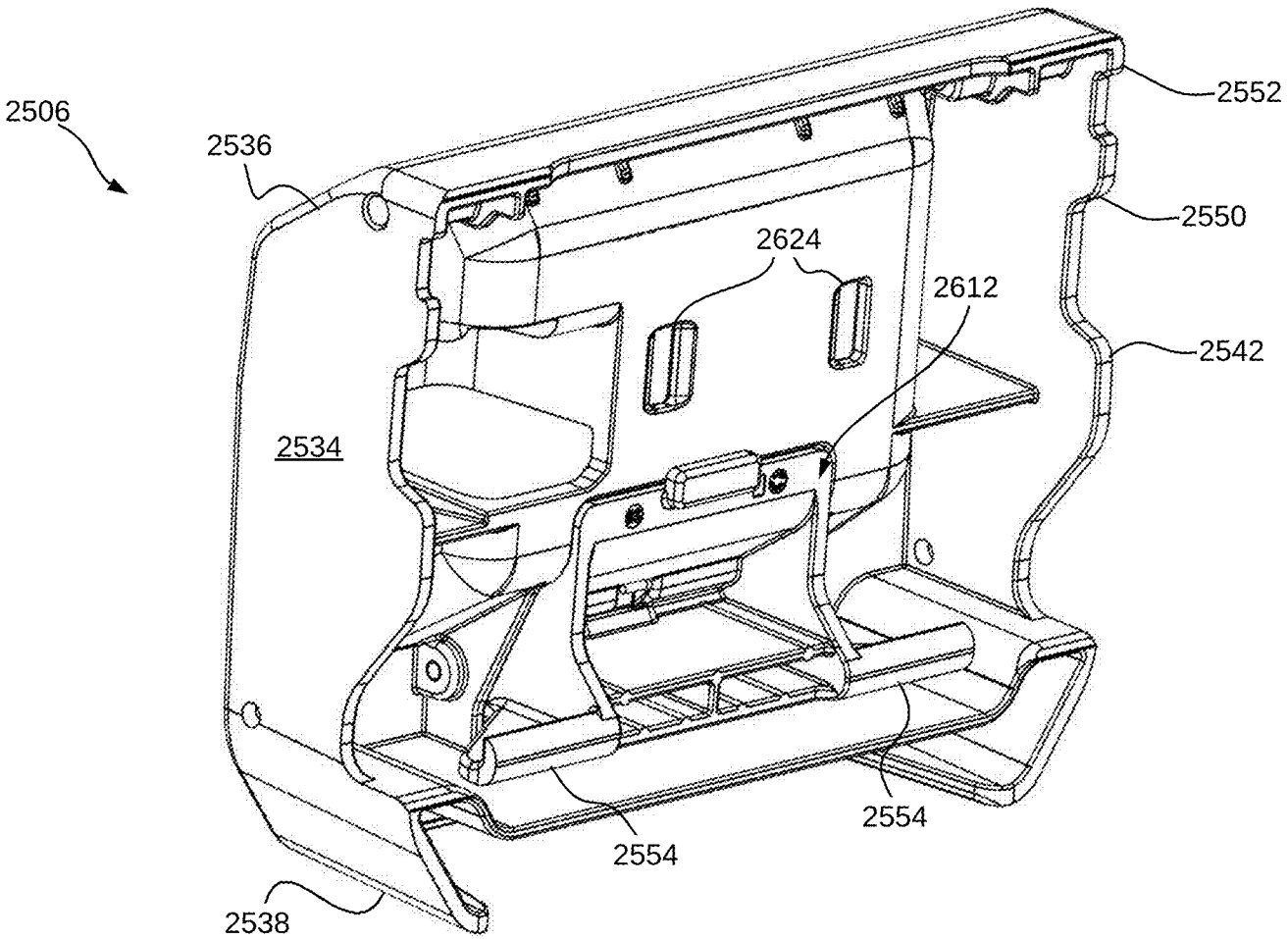
FIG. 26 illustrates a rear perspective view of the latch of FIG. 25, in isolation, in accordance with one or more implementations of the illustrated embodiments.

An alternative latch profile to that seen in FIGS. 9 and 10 can be seen in FIGS. 25 and 26. In particular, FIG. 25 shows a side view of an alternative configuration of a latch 2506 in isolation, in accordance with one or more implementations. As shown in FIG. 25, latch 2506 includes a hole 2510 for receiving a pin (not shown), about which pin latch 2506 rotates. Latch 2506 includes a latch body 2534 with a first end 2536 and a second end 2538. Latch 2506 further includes a latch body 2534, in turn including a plurality of protrusions 2542, 2550, and 2552 for engaging with cooperative features formed into the lid and/or base of the case when assembled. A hook 2554, which forms a part of a button (not visible in FIG. 25) can also be seen in FIG. 25. Latch 2506 operates similarly to latch 106, described in detail above.

Further, FIG. 26 illustrates a rear perspective view of latch 2506 of FIG. 25, in isolation, in accordance with one or more implementations of the illustrated embodiments. The rear side of a button 2612, including hooks 2554, is visible in FIG. 26. Hooks 2554 may operate in a similar manner to hooks 954 of button 112, described in detail above. Latch 2506 also includes slotted holes 2624, similar to slotted holes 124 of case 100, for accommodating a zip-tie, cable, wire, or similar for providing a further measure for preventing unintentional disengagement of latch 2506.

Figure 27:
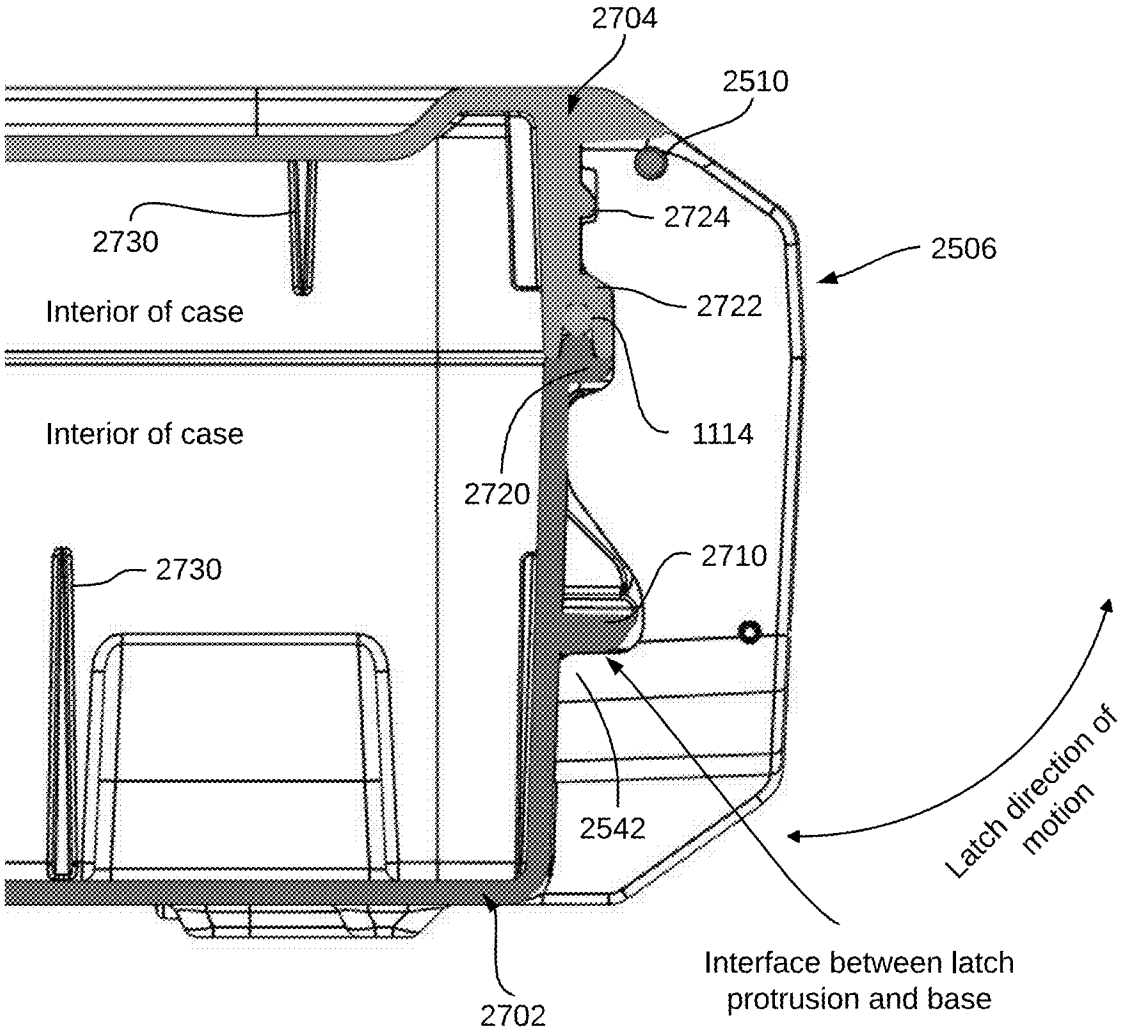
FIG. 27 depicts a side, partial cross-sectional view of the assembled case with a side view of the latch of FIG. 25, shown here to illustrate the operations of the engagement and disengagement of latch, in accordance with an embodiment.

FIG. 27 depicts a side, partial cross-sectional view of the assembled case with a side view of the latch of FIG. 25, shown here to illustrate the operations of the engagement and disengagement of latch, in accordance with an embodiment. In a manner similar to the operations of latch 106 described in FIG. 11, FIG. 27 shows latch 2506 engaging with a base 2702 and 2704. Base 2702 includes a shelf 2710 to define an interface between latch protrusion 2542 and base 2702. Latch protrusion 2542 cooperates with shelf 2710 to engage latch 2506 with base 2702 by friction fit or snap fit, for example. This interface may also serve to provide a compressive force between base 2702 and lid 2704 to compress gasket 1114 therebetween. Additional protruding edge 2720 on base 2702 and protruding edge 2722 on lid 2704 may optionally contribute to keep gasket 1114 trapped between base 2702 and lid 2704 by compressive forces. Optionally, lid 2704 further includes an additional protruding edge 2724, which is configured to separately engage with latch 2506, as will be described in detail relative to FIG. 29 below. FIG. 27 also shows internal rib features 2730, which may be useful in providing structural stability to the case and/or provide additional functionality in the retention of mechanisms such as padding or organizer panels, such as described above with respect to FIGS. 20-22.

Figure 28:
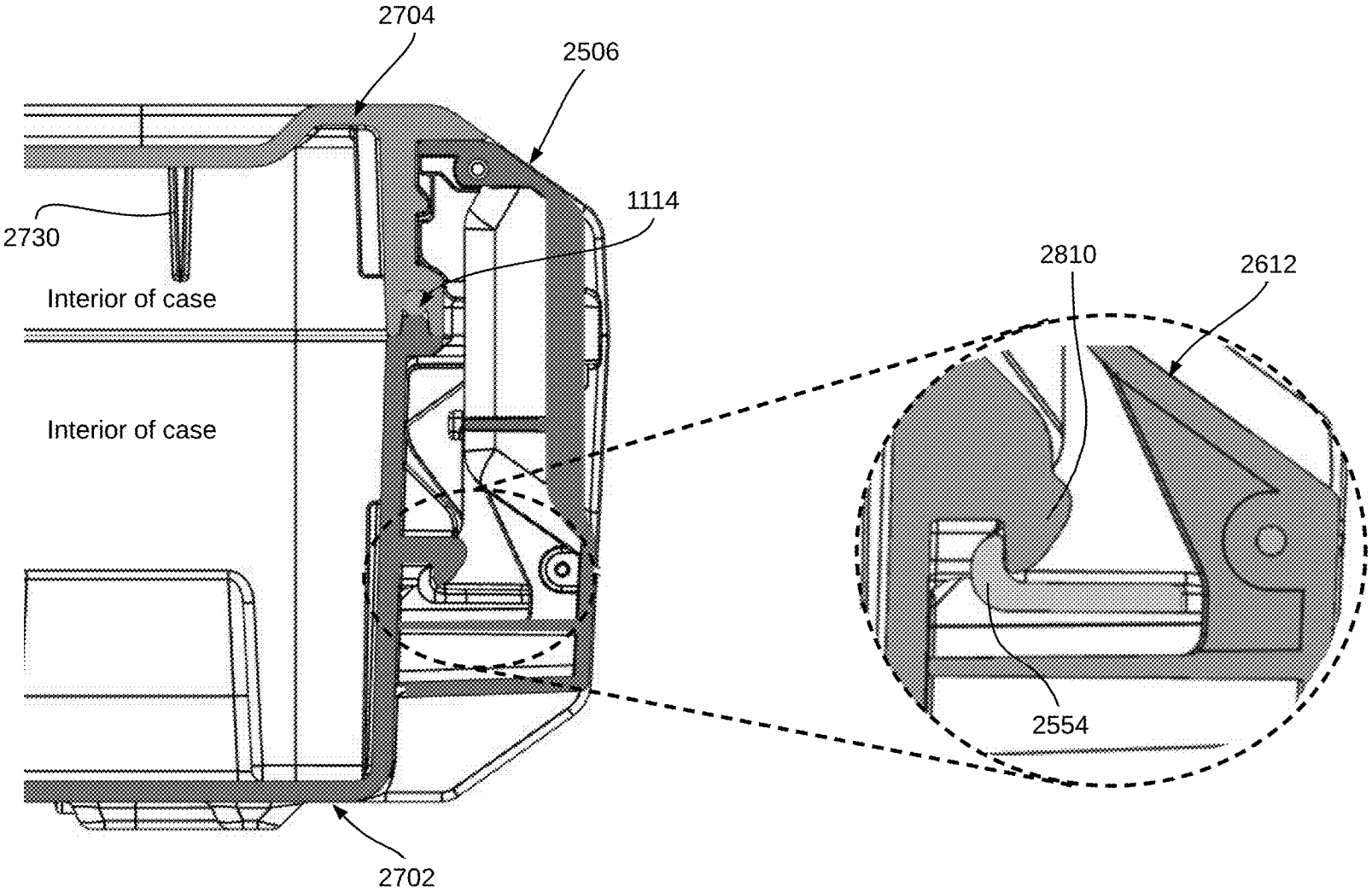
FIG. 28 depicts a side, partial cross-sectional view of the assembled case of FIG. 27, this time including a cross-sectional side view of the latch, in accordance with an embodiment.

FIG. 28 depicts a side, partial cross-sectional view of the assembled case of FIG. 27, this time including a cross-sectional side view of the latch, in accordance with an embodiment. In particular, FIG. 28 shows engagement of hook 2554 of button 2612 with a cooperating feature 2810 formed as part of shelf 2710 of base 2702.

Figure 29:
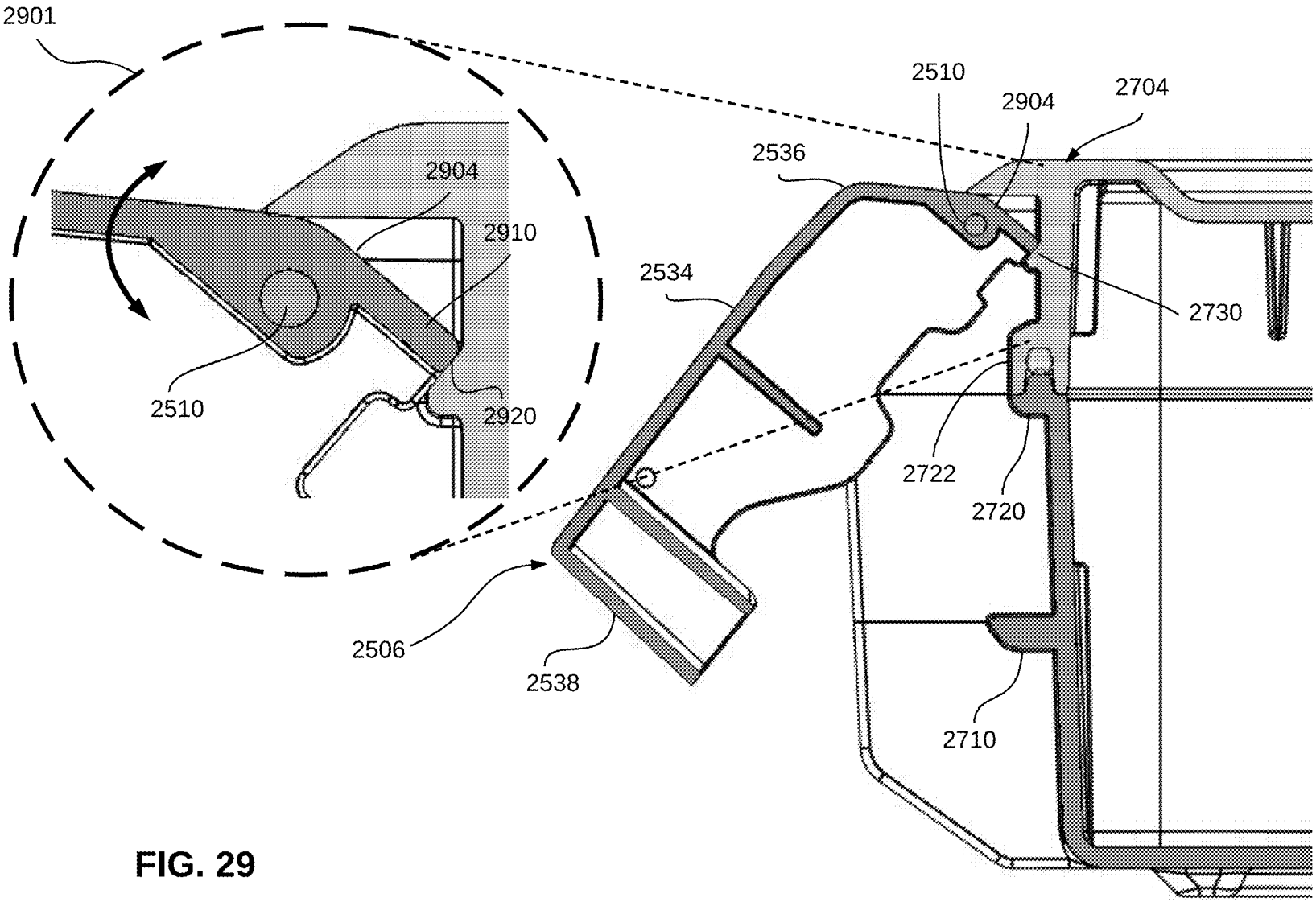
FIG. 29 illustrates another cross-sectional side view and an inset of a portion of the case of FIGS. 27 and 28, included here to illustrate a detent-open mechanism.

An alternative detent-open mechanism is shown in FIG. 29. More particularly, FIG. 29 illustrates another cross-sectional side view and an inset of a portion of the case of FIGS. 27 and 28, included here to illustrate a detent-open mechanism. Similar to the detent-open mechanism described with respect to FIG. 13 above, FIG. 29 includes an inset 2901 showing the engagement of a top portion 2904 of latch 2506 with cooperating features in lid 2704. In particular, a tip 2910 of latch 2506 is configured to engage with a surface 2920, which forms a portion of protrusion 2730. In an example, surface 2920 is of such dimensions as to initially catch tip 2910 when latch 2506 is disengaged from base 2702. Optionally, surface 2920 may be short enough such that, when sufficient additional upward force is applied to latch 2506, tip 2910 is able to slip past surface 2920 and be opened further than shown in FIG. 29.

Figure 30:
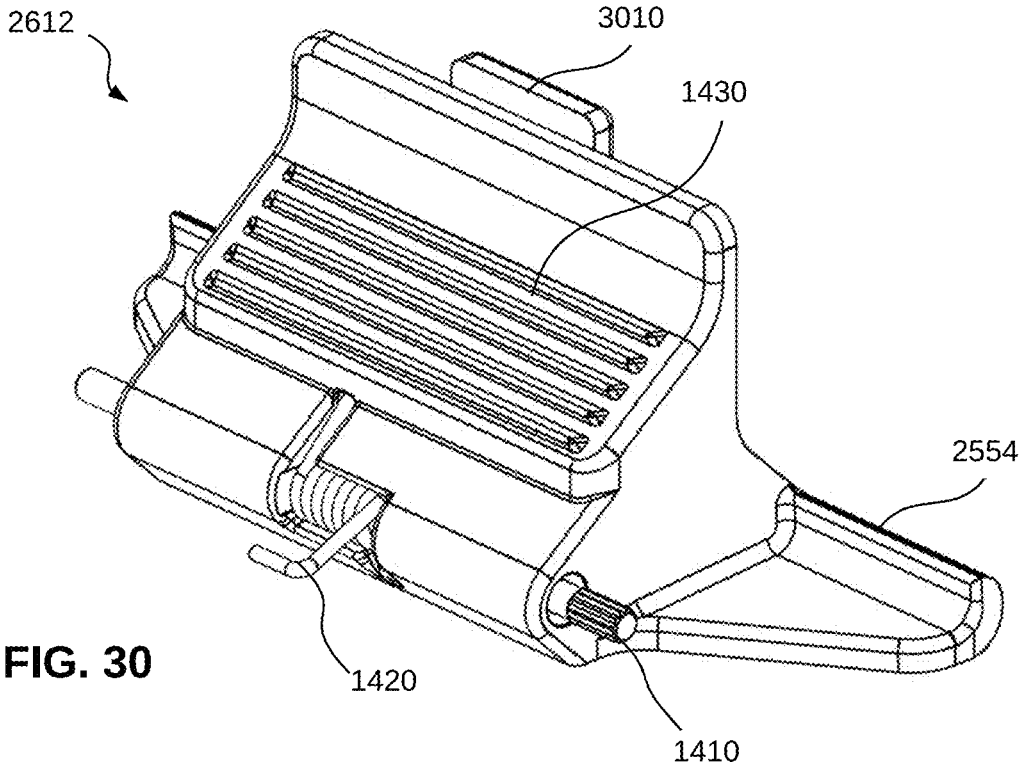
FIGS. 30 and 31 show front perspective and side views, respectively of an alternative configuration of a button for use with the latch illustrated in the above figures, in isolation, in accordance with an embodiment.
Figure 31:
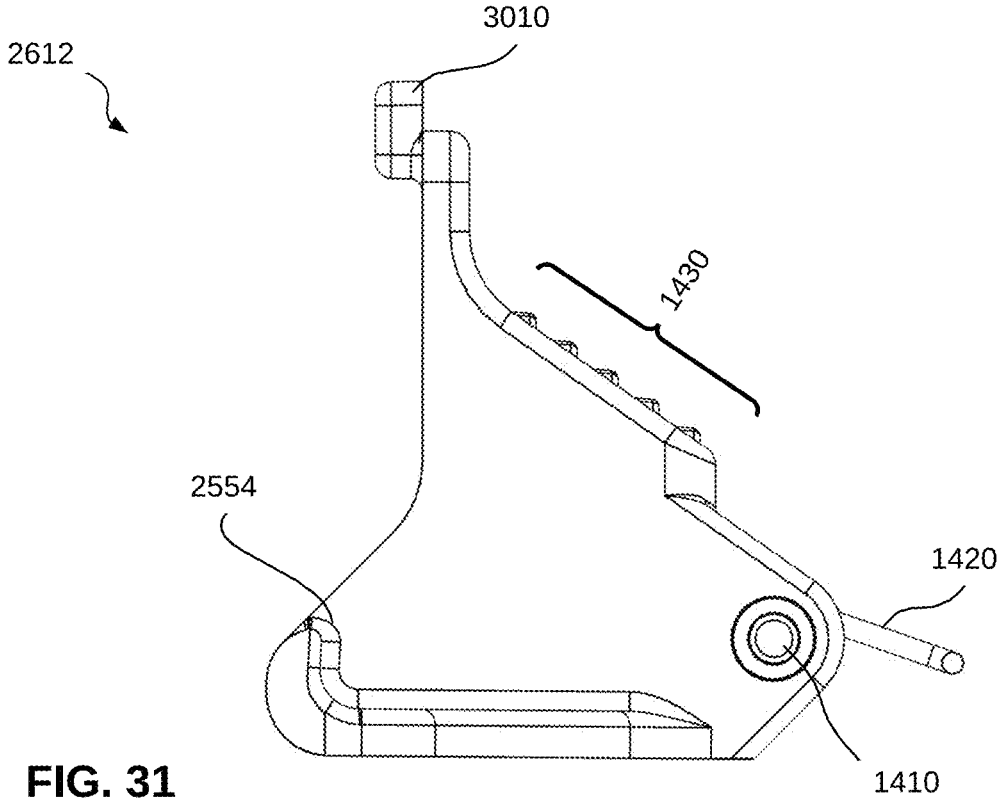

An alternative configuration of a button can be seen in FIGS. 30 and 31. FIGS. 30 and 31 show front perspective and side views, respectively of button 2612 for use with the latch illustrated in the above figures, in isolation, in accordance with an embodiment. In addition to the various features of button 112 described above, button 2612 includes a tab 3010 for assisting with the retention of button 112 in the appropriate position within latch 2506, in an embodiment.

While generally described in relation to firearms, it should be noted that the case described herein may be utilized for transporting items other than firearms (e.g., rifles, pistols, and shotguns) and/or their accessories. For instance, musical, scientific, photographic, and technical equipment are just a few examples of other item types that may benefit from herein disclosed embodiments of storage and transport cases. Further, the case organizer(s) and/or case organizer blocks depicted in FIGS. 17-19 may be utilized with cases and containers other than the embodiments depicted herein. Similarly, embodiments of cases described herein may be utilized with any other type of case organizer known or contemplated in the art.

As used herein, the recitation of "at least one of A, B and C" is intended to mean "either A, B, C or any combination of A, B and C." The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

The terms and expressions employed herein are used as terms and expressions of description and not of limitation, and there is no intention, in the use of such terms and expressions, of excluding any equivalents of the features shown and described or portions thereof. Each of the various elements disclosed herein may be achieved in a variety of manners. This disclosure should be understood to encompass each such variation, be it a variation of an embodiment of any apparatus embodiment, a method or process embodiment, or even merely a variation of any element of these. Particularly, it should be understood that the words for each element may be expressed by equivalent apparatus terms or method terms-even if only the function or result is the same. Such equivalent, broader, or even more generic terms should be considered to be encompassed in the description of each element or action. Such terms can be substituted where desired to make explicit the implicitly broad coverage to which this invention is entitled.

As but one example, it should be understood that all action may be expressed as a means for taking that action or as an element which causes that action. Similarly, each physical element disclosed should be understood to encompass a disclosure of the action which that physical element facilitates. Regarding this last aspect, by way of example only, the disclosure of a "protrusion" should be understood to encompass disclosure of the act of "protruding"—whether explicitly discussed or not—and, conversely, were there only disclosure of the act of "protruding", such a disclosure should be understood to encompass disclosure of a "protrusion". Such changes and alternative terms are to be understood to be explicitly included in the description.

The invention claimed is:

1. A locking case including a base and a lid, the case comprising:

a latch recess integrated into an outer profile of the case; and a latch installed within the latch recess and including a latch handle including a first end rotatably coupled with the lid of the case, and further including a second end including an end protrusion configured for removably engaging with a first portion of the base of the case, and a passthrough feature for accommodating a lock mechanism therethrough, wherein the latch recess is larger than the locking mechanism, wherein the latch recess accommodates the latch and the lock mechanism therein when the second end of the latch handle is engaged with the first portion of the base of the case and the lock mechanism is installed through the passthrough feature such that the latch and the lock mechanism do not substantially protrude from the outer profile of the case, wherein the latch further includes a button, wherein the button includes at least one hook mechanism for engaging with a second portion of the base of the case, and wherein the button is rotatably coupled with the latch handle such that the at least one hook mechanism remains engaged with the second portion of the base of the case, independently from the second end of the latch handle, unless the button is depressed to disengage the at least one hook mechanism from the second portion of the base of the case.

2. The case of claim 1, wherein the lock mechanism is a padlock.

3. The case of claim 1, wherein the lid of the case includes a recess for capturing a tip of the first end of the latch handle when the second end of the latch handle is disengaged from the portion of the base of the case and rotated to an open position such that the latch handle is retained in the open position by the recess.

4. The case of claim 1, further comprising a gasket positioned between the base and the lid of the case, wherein the first portion of the base of the case includes a shelf feature for engaging with the second end of the latch handle, and wherein the shelf feature is configured to transfer an engagement force from the latch handle toward the lid of the case when the second end of the latch handle is engaged with the first portion of the base of the case, such that the gasket becomes more compressed between the base and the lid than when the second end of the latch handle is not engaged with the first portion of the base of the case.

5. The case of claim 1, wherein the latch handle includes a latch width greater than two inches.

6. The case of claim 5, wherein the latch width is greater than three inches.

7. The case of claim 1, further comprising two or more slotted holes for accommodating an elongated locking mechanism therethrough.

8. A locking case including a base and a lid, the case comprising:

a latch recess integrated into an outer profile of the case; and a latch installed within the latch recess and including a latch handle including a first end rotatably coupled with the lid of the case, and further including a second end including an end protrusion configured for removably engaging with a first portion of the base of the case, and a button including at least one hook mechanism for engaging with a second portion of the base of the case, wherein the button is rotatably coupled with the latch handle such that the at least one hook mechanism remains engaged with the second portion of the base of the case, independently from the second end of the latch handle, unless the button is depressed to disengage the at least one hook mechanism from the second portion of the base of the case, wherein the latch further includes a passthrough feature for accommodating a lock mechanism therethrough, and wherein, when the lock mechanism is installed through the passthrough feature, the lock mechanism at least partly blocks access to the button such that the button is prevented from being depressed.

9. The locking case of claim 8, wherein the at least one hook mechanism of the button remains engaged with the second portion of the base of the case until the button is depressed, even when the second end of the latch handle is disengaged from the first portion of the base of the case.

10. The locking case of claim 8, wherein the button further includes a bias spring for biasing the at least one hook mechanism to remain engaged with the second portion of the base of the case until the button is depressed.

11. The locking case of claim 8, further comprising two or more slotted holes for accommodating an elongated locking mechanism therethrough to secure the lock mechanism within the latch recess.

12. A locking case including a base and a lid, the case comprising:

a latch recess integrated into an outer profile of the case; and a latch installed within the latch recess and including a latch handle including a first end rotatably coupled with the lid of the case, and further including a second end including an end protrusion configured for removably engaging with a first portion of the base of the case, and a passthrough feature for accommodating a lock mechanism therethrough, wherein the latch recess is larger than the locking mechanism, wherein the latch recess accommodates the latch and the lock mechanism therein when the second end of the latch handle is engaged with the first portion of the base of the case and the lock mechanism is installed through the passthrough feature such that the latch and the lock mechanism do not substantially protrude from the outer profile of the case, and wherein the lid of the case includes a recess for capturing a tip of the first end of the latch handle when the second end of the latch handle is disengaged from the portion of the base of the case and rotated to an open position such that the latch handle is retained in the open position by the recess.

13. The case of claim 12, wherein the lock mechanism is a padlock.

14. The case of claim 12, wherein the latch further includes a button, wherein the button includes at least one hook mechanism for engaging with a second portion of the base of the case, and wherein the button is rotatably coupled with the latch handle such that the at least one hook mechanism remains engaged with the second portion of the base of the case, independently from the second end of the latch handle, unless the button is depressed to disengage the at least one hook mechanism from the second portion of the base of the case.

15. The case of claim 12, further comprising a gasket positioned between the base and the lid of the case, wherein the first portion of the base of the case includes a shelf feature for engaging with the second end of the latch handle, and wherein the shelf feature is configured to transfer an engagement force from the latch handle toward the lid of the case when the second end of the latch handle is engaged with the first portion of the base of the case, such that the gasket becomes more compressed between the base and the lid than when the second end of the latch handle is not engaged with the first portion of the base of the case.

16. The case of claim 12, wherein the latch handle includes a latch width greater than two inches.

17. The case of claim 16, wherein the latch width is greater than three inches.

18. The case of claim 12, further comprising two or more slotted holes for accommodating an elongated locking mechanism therethrough.

* * * * *